US010012935B2

(12) United States Patent
Nishizawa et al.

(10) Patent No.: US 10,012,935 B2
(45) Date of Patent: Jul. 3, 2018

(54) IMAGE FIXING APPARATUS

(71) Applicant: CANON KABUSHIKI KAISHA, Tokyo (JP)

(72) Inventors: Yuki Nishizawa, Yokohama (JP); Seiji Obata, Mishima (JP); Hirotomo Tamiya, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/371,837

(22) Filed: Dec. 7, 2016

(65) Prior Publication Data

US 2017/0160682 A1 Jun. 8, 2017

(30) Foreign Application Priority Data

Dec. 8, 2015 (JP) ..... 2015-239272

(51) Int. Cl.
*G03G 15/20* (2006.01)

(52) U.S. Cl.
CPC ..... *G03G 15/206* (2013.01)

(58) Field of Classification Search
CPC ..... G03G 15/2039; G03G 15/2057
See application file for complete search history.

(56) References Cited

U.S. PATENT DOCUMENTS

| | | | |
|---|---|---|---|
| 9,377,733 | B2 | 6/2016 | Nishizawa et al. |
| 9,563,159 | B2 | 2/2017 | Jota et al. |
| 2016/0231679 | A1 | 8/2016 | Nishizawa et al. |
| 2017/0146935 | A1* | 5/2017 | Obata ..... G03G 15/2053 |

FOREIGN PATENT DOCUMENTS

| | | | |
|---|---|---|---|
| JP | 2000-81806 | A | 3/2000 |
| JP | 2001-332378 | A | 11/2001 |
| JP | 2003-323069 | A | 11/2003 |
| JP | 2003-330291 | A | 11/2003 |
| JP | 2014-26267 | A | 2/2014 |

OTHER PUBLICATIONS

Unpublished, co-pending U.S. Appl. No. 15/358,849, filed Nov. 22, 2016.
Unpublished, co-pending U.S. Appl. No. 15/358,954, filed Nov. 22, 2016.

* cited by examiner

*Primary Examiner* — David M Gray
*Assistant Examiner* — Michael Harrison
(74) *Attorney, Agent, or Firm* — Fitzpatrick, Cella, Harper & Scinto

(57) ABSTRACT

An image fixing apparatus includes a cylindrical rotatable member including an electroconductive layer and having a hole at least at one of longitudinal end portions, a driving member engaged with the longitudinal end portion to rotate the rotatable member and including a claw engaged with the hole, a coil provided inside the rotatable member for forming an alternating magnetic field for heat generation of the electroconductive layer, and a magnetic core. The rotatable member generates heat by a current flowing in a circumferential direction of the rotatable member induced in the electroconductive layer in the magnetic field. The rotatable member is provided with a slot at the longitudinal end, the slot being disposed at a position different from a position of the hole with respect to the circumferential direction of the rotatable member and overlapping the hole with respect to a longitudinal direction of the rotatable member.

4 Claims, 14 Drawing Sheets

(a)

(b)

IMAGE FIXING APPARATUS

FIELD OF THE INVENTION AND RELATED ART

The present invention relates to an image heating device which is preferable as a fixing device to be mounted in an image forming apparatus such as an electrophotographic copying machine, an electrophotographic printing machine, and the like. It relates also to a cylindrical rotational member to be employed by the image heating device.

A heating device based on electromagnetic induction has long been known as a fixing device to be mounted in an image forming apparatus such as an electrophotographic copying machine, an electrophotographic printing machine, and the like. This type of heating device has an excitation coil, a fixation roller in which heat is generated by the magnetic flux generated by the excitation coil, and a pressure roller which forms a nip by being pressed on the fixation roller. A sheet of recording medium on which an unfixed toner image is borne is heated while it is conveyed through the nip, remaining pinched between the fixation roller and the pressure roller. Consequently, the toner image is fixed to the sheet.

This type of fixing device heats the fixation roller, which is a piece of pipe with thin wall, and, therefore, which has a small thermal capacity. Thus, an advantage of this type of fixing device is that it can reduce an image forming apparatus in the length of warm-up time.

A fixing device which employs a piece of pipe with thin wall is structured so that a driving gear is fixed to one of the lengthwise ends of the fixation roller. More specifically, the inner surface of the driving gear, which is in the form of a ring, is provided with a protrusion shaped like a key, whereas the corresponding end of the fixation roller is provided with such a slot that matches the shape of the key of the driving gear. Thus, as the lengthwise end of the fixation roller, which has the slot, is inserted into the driving gear to fix the driving gear to the fixation roller, the key of the driving gear fits into the slot of the fixation roller.

There are disclosed fixing devices which use a heating method based on electromagnetic induction, in Japanese Laid-open Patent Application Nos. 2000-81806, 2014-26267, and 2003-330291. The fixing device disclosed in Japanese Laid-open Patent Application No. 2000-81806 has a fixation roller, an electrically conductive layer, which is made of magnetic metal such as iron, nickel, etc., and which is easily permeable by magnetic flux, and a spiral excitation coil disposed in a hollow of the fixation roller, in parallel to an axial line of the fixation roller, in order to guide a magnetic flux generated by a magnetic field generating means, to a conductive layer of the fixation roller. As the magnetic flux is guided into the conductive layer of the fixation roller, the magnetic flux generates an eddy current primarily inside the conductive layer, generating thereby heat (Joule's heat) in the conductive layer. Consequently, the fixation roller is heated.

As for the fixing device disclosed in Japanese Laid-open Patent Application No. 2014-26267, the fixing device has a spiral excitation coil disposed in a hollow of a fixation roller, in parallel to an axial line of the fixation roller, and a magnetic core disposed in a hollow of the spiral excitation coil to guide the magnetic flux generated by a magnetic field generating means in such a manner that the magnetic flux does not go through a conductive layer of the fixation roller.

That is, the fixing device is considered as a magnetic circuit. Then, a state, which can serve as an index for indicating the level of easiness with which magnetism can permeate the magnetic circuit in the direction parallel to the lengthwise direction of the fixation roller, is created. That is, regarding a "magnetic resistance in terms of the lengthwise direction of the fixation roller", such a state that "magnetic resistance of the magnetic core" is negligibly small in terms of the lengthwise direction, and the magnetic resistance of the fixation roller in terms of its lengthwise direction, and the magnetic resistance of an inward side of the fixation roller in terms of the lengthwise direction of the fixation roller are satisfactorily large. Thus, it is possible to design a fixing device in which magnetic flux is concentrated into the magnetic core, and does not go through the fixation roller nor the inward side of the fixation roller.

The conductive layer of the fixation roller is subjected to such voltage that a current is generated in the circumferential direction of the fixation roller. Thus, heat (Joule's heat) is efficiently generated by the circular current generated by the voltage. Compared to the method disclosed in Japanese Laid-open Patent Application No. 2000-81806, this method does not require that the magnetic flux is guided to the conductive layer of the fixation roller. Therefore, an advantage of the fixing device is that it is free from the requirements regarding the thickness of the conductive layer, and the material for the conductive layer.

A fixing device is intended to heat a sheet of recording medium. Therefore, it is desired that a fixing device is as small as possible in the amount by which it generates heat in portions which are out of the path of a sheet of recording medium (these portions may be referred to as "out-of-sheet-path areas", hereafter). There is disclosed in Japanese Laid-open Patent Application No. 2003-330291, a fixing device in which the out-of-sheet-path portions of the conductive layer of the rotational heating member of are provided with slots for preventing the out-of-sheet-path portions from generating heat.

However, a fixing device structured so that its driving gear and fixation roller are provided with a key (protrusion) and a slot (key slot), respectively, and so that as the driving gear is attached to (fitted around) one of the lengthwise ends of the fixation roller, the key fits into the slot, suffers from the following issue. That is, as the driving gear is rotated by the meshing of the driving gear with another gear from which driving force is transmitted to the driving gear, the portions of the lengthwise end portions, which are adjacent to the key slot of the lengthwise end portion of the fixation roller, are subjected to such stress that tends to widen the key slot. This stress acts on the lengthwise end of the fixation roller in a manner so as to bend the adjacencies of the key slot outward in terms of the radius direction of the fixation roller. That is, the stress widens the key slot. In other words, this setup makes the lengthwise end portion of the fixation roller insufficient in mechanical strength, therefore making the lengthwise end portion of the fixation roller susceptible to damage. Further, the portion of the lengthwise end portion of the fixation roller, which is adjacent to the inward end of the key slot, is likely to be split by the stress which works in a manner to bend the portions of the fixation roller, which are adjacent to the key slot, outward in terms of the radius direction of the fixation roller. Therefore, it is necessary to increase a fixation roller in the thickness of its wall, in order to strengthen the fixation roller.

This solution, however, was problematic in that increasing a fixation roller in the thickness of its wall increases the fixation roller in thermal capacity, which in turn increases the fixation roller in the length of time it takes to warm up the fixation roller. As a result, the power consumption of the fixing device is increased.

Further, regarding the prevention of the heat generation in the out-of-sheet-path portions of the fixation roller, a fixing device such as the one disclosed in Japanese Laid-open Patent Application No. 2014-26267 suffers from the following problem. That is, if the out-of-sheet-path portions of the conductive layer of a fixation roller are provided with a slot that extends in the direction parallel to the axial line of the fixation roller, and voltage is applied to the conductive layer of the fixation roller, in the circumferential direction of the conductive layer, the current induced by the voltage flows in a manner to circumvent the slot (this current may be referred to as "circumventive current"). Consequently, the circumventive current concentrates into the adjacencies of the inward end of the slot.

Thus, the adjacencies of the inward end of the slot, into which the circumventive current concentrates, increases the amount by which heat is generated. That is, it becomes higher in temperature than the other portions of the fixation roller, making it possible that the key portion (protrusion) of the driving gear will be reduced in mechanical strength by the heat generated in the out-of-sheet-path portion, and/or the heat generated in the adjacencies of the inward end of the slot by the circumventive current. Therefore, it is possible that the key portion (protrusion) of the driving gear will break.

One of the possible solutions to this problem is to provide the lengthwise end portions of the fixation roller with multiple slots, and distribute the slots in the circumferential direction of the fixation roller, in order to prevent the circumventive current from concentrating to the adjacencies of the inward end of a single slot. This setup also possibly reduces the lengthwise end portions of the fixation roller in mechanical strength. In particular, in a case of a fixing device structured so that one of the lengthwise ends of its fixation roller is fitted with a driving gear to rotationally drive the fixation roller, a reduction in the mechanical strength of the lengthwise ends of the fixation roller possibly leads to such a problem as the damage to the fixation roller.

Thus, the primary object of the present invention is to provide a cylindrical rotational member which is superior to any conventional one in that the lengthwise end portion of its conductive layer, to which a driving member is attached, is significantly less likely to be damaged than the counterpart of the conventional one, and an image heating device equipped with this cylindrical rotational member.

SUMMARY OF THE INVENTION

According to an aspect of the present invention, there is provided a fixing apparatus for forming an image on a recording material, said fixing apparatus comprising a cylindrical rotatable member including an electroconductive layer and provided with a hole portion at least at one of longitudinal end portions; a driving member engaged with the longitudinal end portion of said rotatable member and configured to rotate said rotatable member, said driving member being provided with a claw portion engaged with said hole portion of said rotatable member; a coil provided inside said rotatable member and configured to form an alternating magnetic field capable of causing electromagnetic induction heat generation of said electroconductive layer, said coil including a helical configuration portion having a helicity axis extending along a generatrix direction of said rotatable member; and a magnetic core provided inside said helical configuration portion, wherein said rotatable member generates heat by a current flowing in a circumferential direction of said rotatable member induced in said electroconductive layer in the alternating magnetic field, and wherein said rotatable member is provided with a slit at the longitudinal end portion, said slit being disposed at a position different from a position of said hole portion with respect to the circumferential direction of said rotatable member and overlapping said hole portion with respect to a longitudinal direction of said rotatable member.

Further features of the present invention will become apparent from the following description of exemplary embodiments with reference to the attached drawings.

Figure 2:
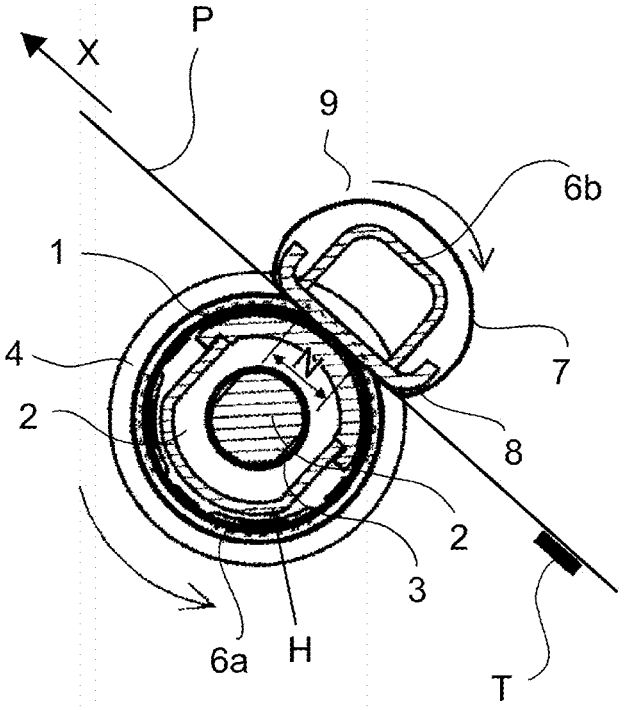
FIG. 2 is a sectional view of a fixing device in accordance with the present invention.
Figure 3:
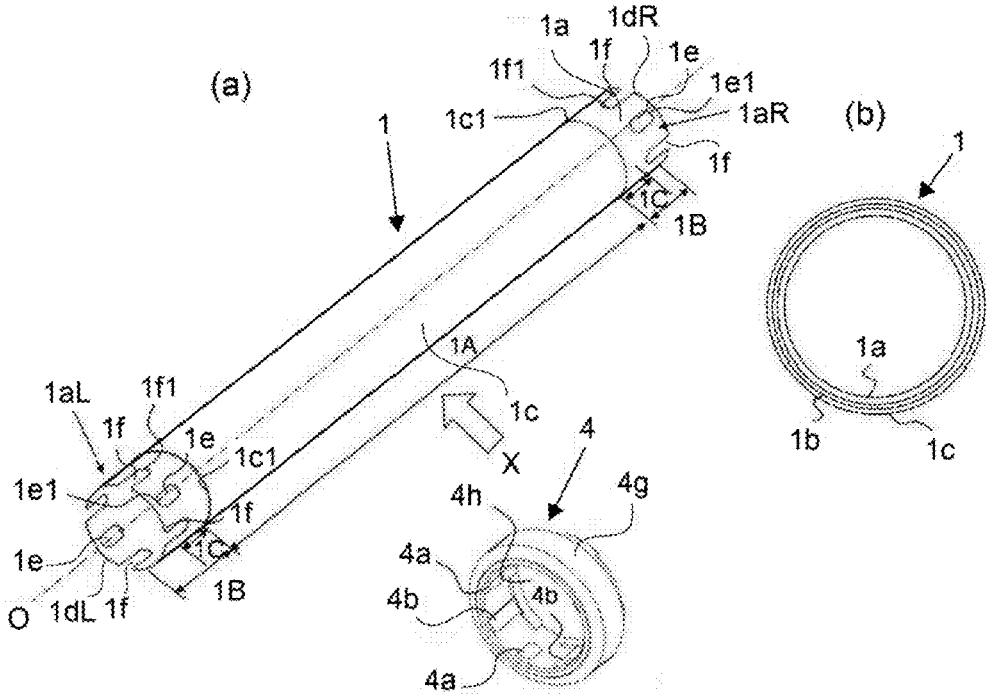

Parts (a) and (b) of FIG. 3 are drawings for describing the fixation roller and driving gear of the fixing device, shown in FIG. 2.

Figure 4:
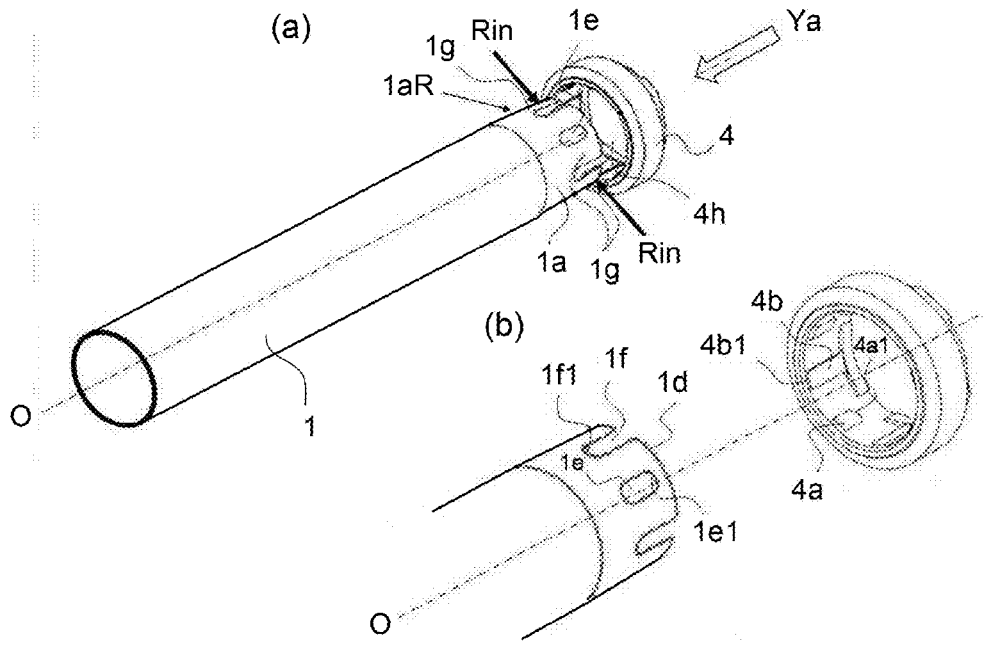

Parts (a) and (b) of FIG. 4 are drawings for describing how the driving gear is attached to the fixation roller.

Figure 5:
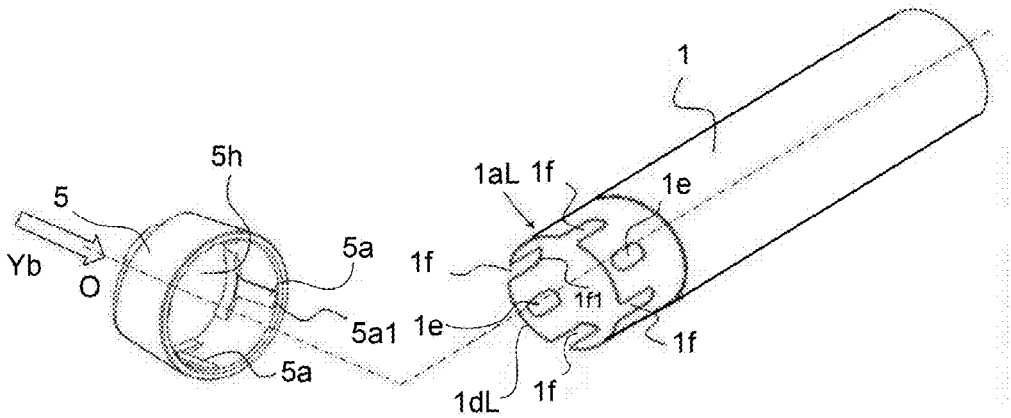

FIG. 5 is a drawing for describing how a roller cap is attached to the fixation roller.

Figure 6:
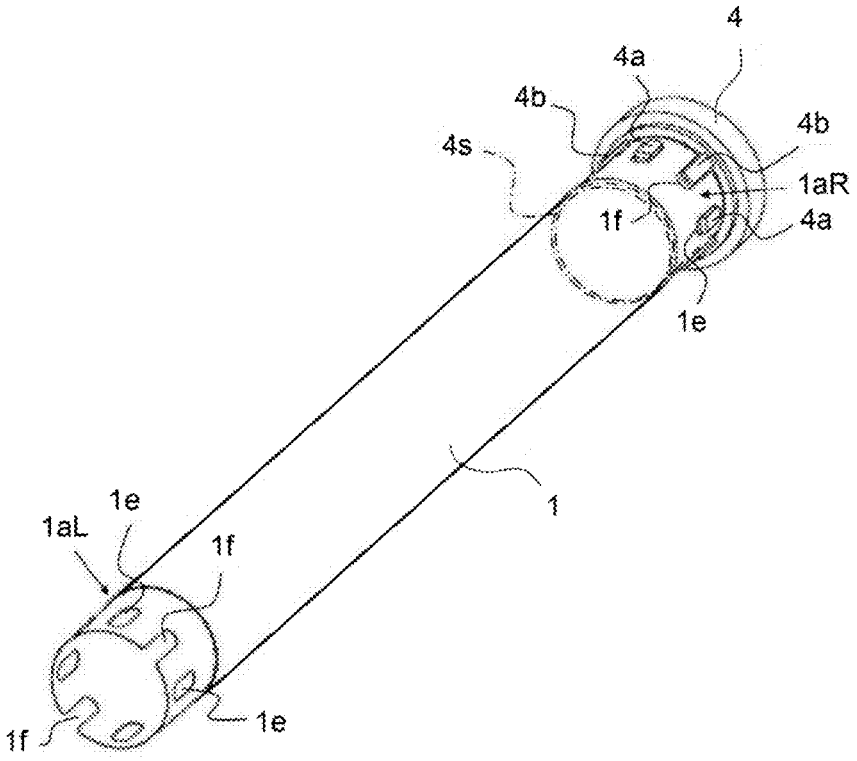

FIG. 6 is a perspective view of a modified version of the combination of the fixation roller and driving gear shown in FIG. 3.

Figure 7:
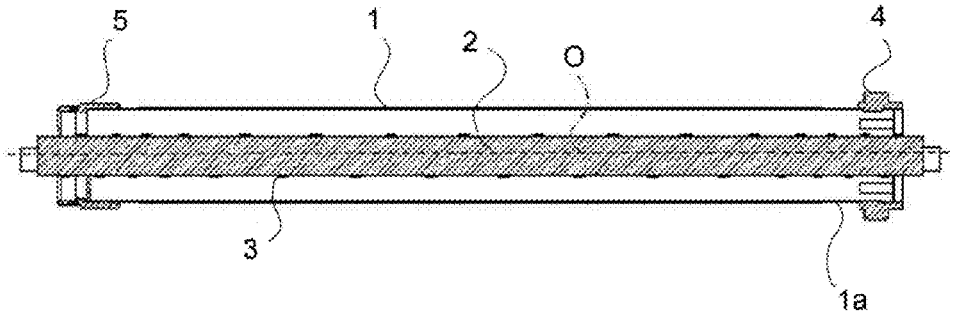

FIG. 7 is a sectional view of a combination of the fixation roller, and a heating means disposed in the hollow of the fixation roller.

Figure 8:
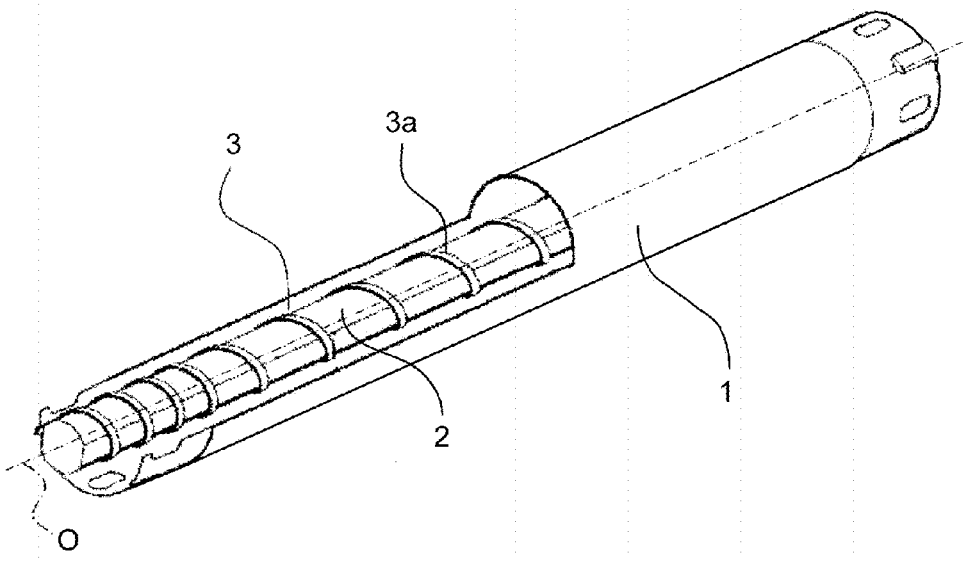

FIG. 8 is a perspective cutaway view of the fixation roller.

Figure 9:
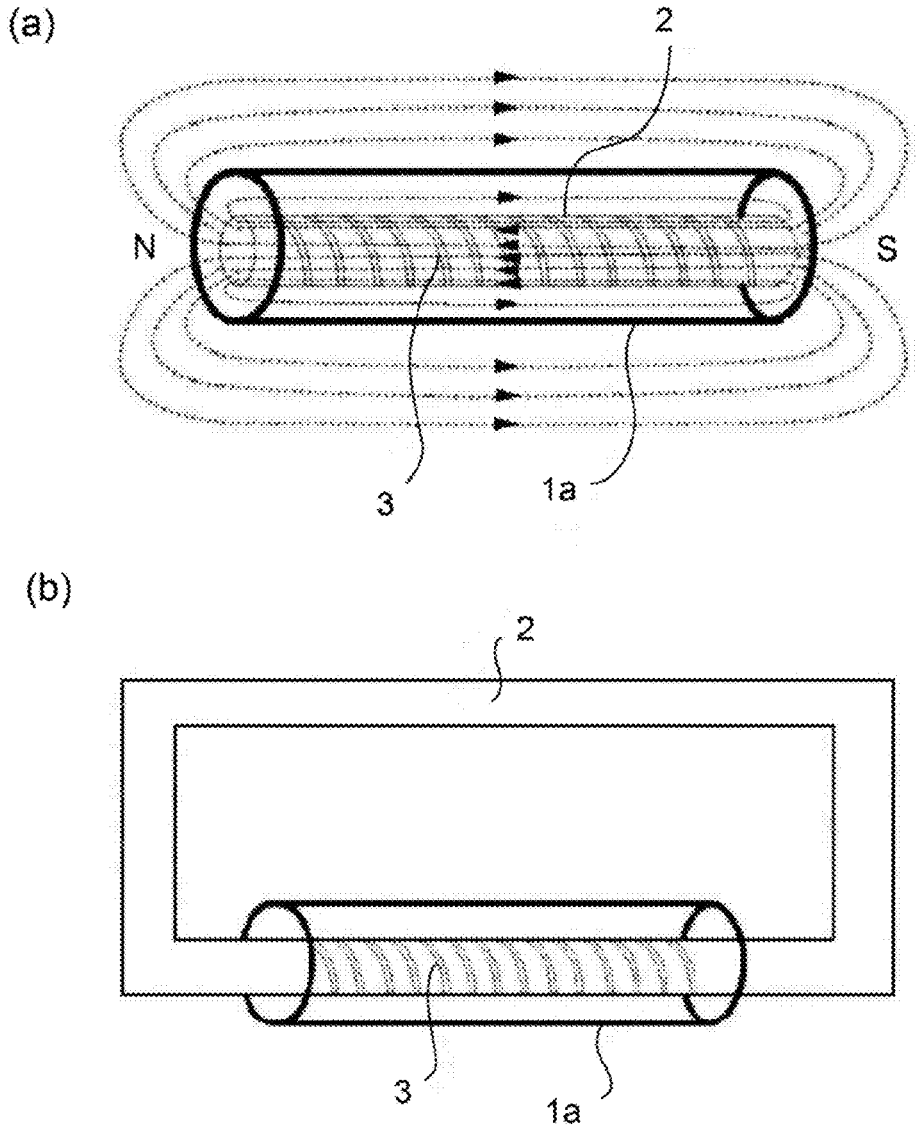

Parts (a) and (b) of FIG. 9 are drawings for describing the heat generation mechanism that generates heat in the conductive layer of the fixation roller.

Figure 10:
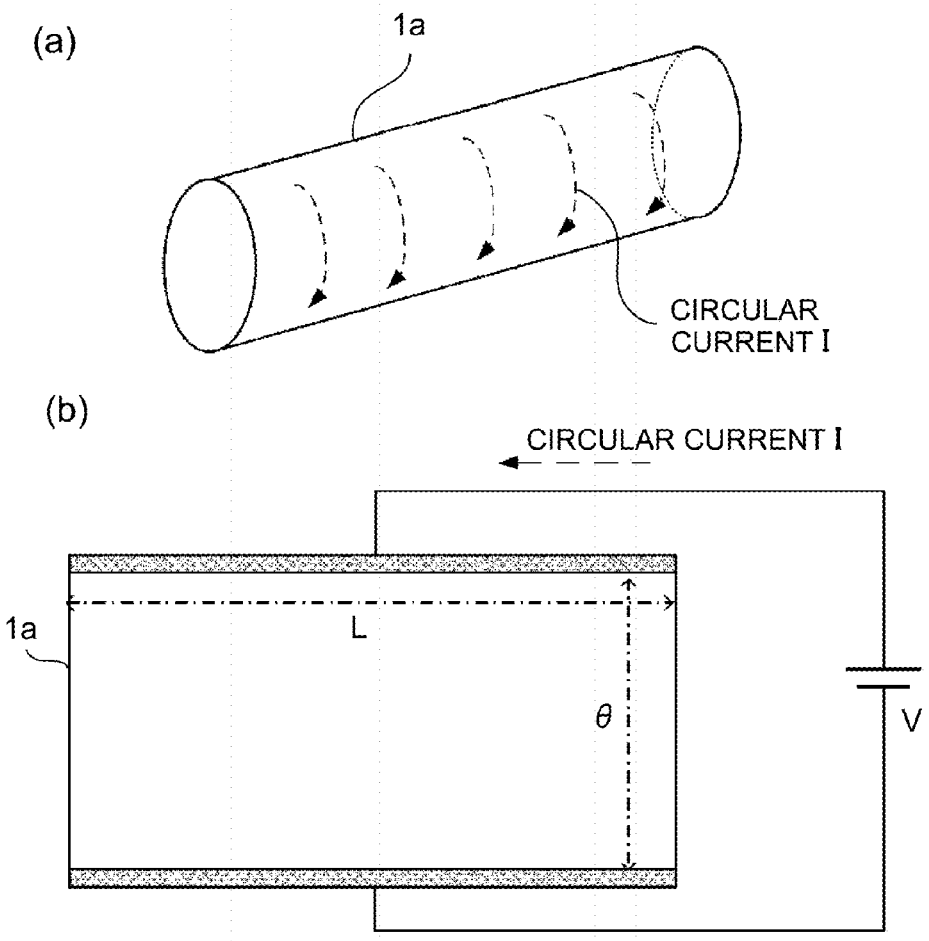

Part (a) of FIG. 10 is a drawing that shows the current flow to the conductive layer of a slot-less fixation roller, through which current is flowing in the circumferential direction of the conductive layer, and part (b) of FIG. 10 is a circuit that is equivalent in current flow to the conductive layer, through which current is flowing in the direction perpendicular to the lengthwise direction of the conductive layer, if it is assumed that the conductive layer is extended (opened) flat by being cut along a straight line perpendicular to the axial line of the fixation roller.

Figure 11:
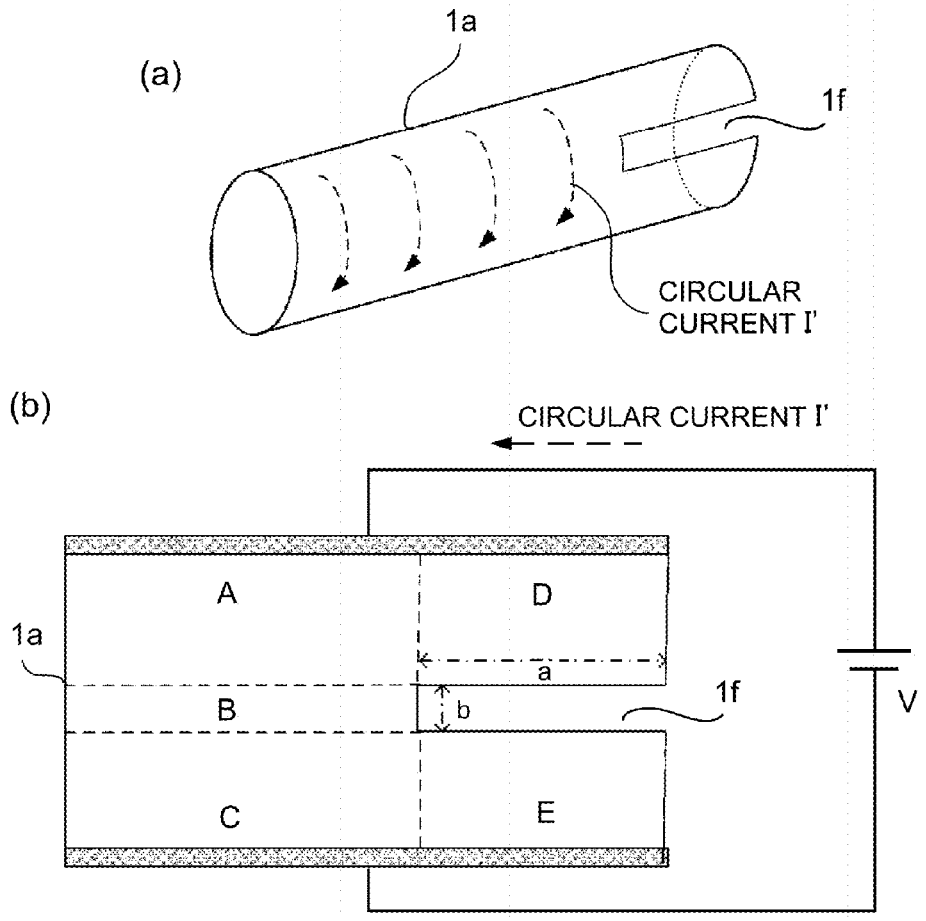

Part (a) of FIG. 11 is a drawing that shows the current flow to the conductive layer of a slotted fixation roller, through which current is flowing in the circumferential direction of the conductive layer, and part (b) of FIG. 11 is a circuit that is equivalent in current flow to the conductive layer, through which current is flowing in the direction perpendicular to the lengthwise direction of the conductive layer, if it is assumed that the conductive layer is extended (opened) flat by being cut along a straight line perpendicular to the axial line of the fixation roller.

Figure 12:
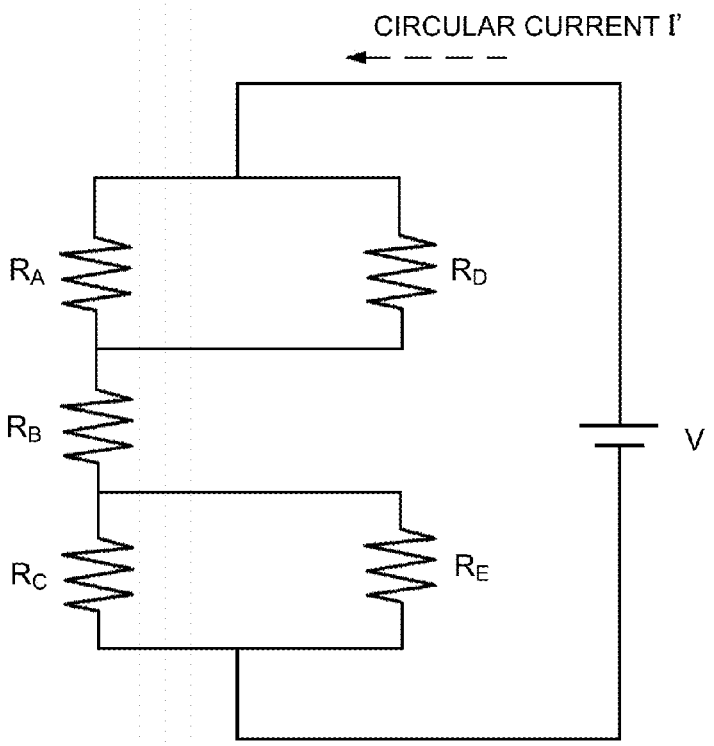

FIG. 12 is an electrical circuit that is equivalent to current flow through the conductive layer, and in which five areas of the conductive layer shown in part (b) of FIG. 11 are substituted by electrical resistances.

Figure 13:
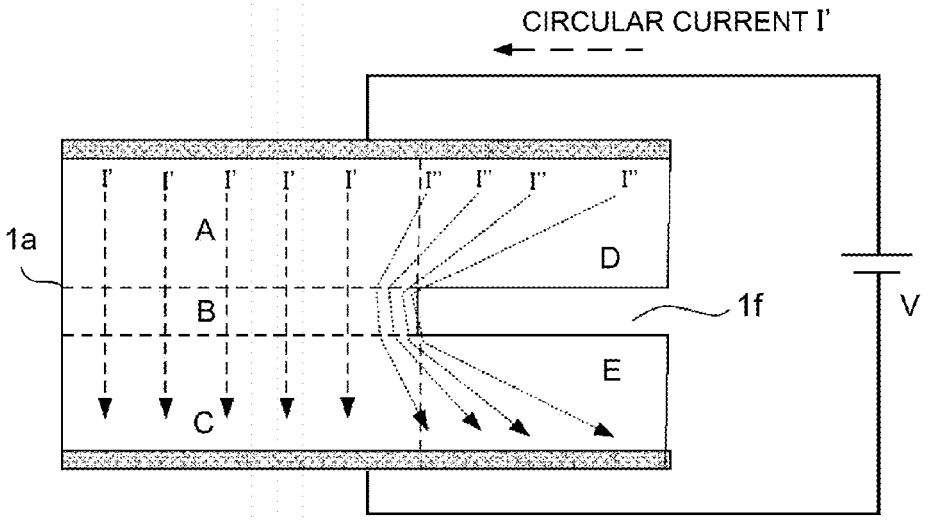

FIG. 13 is an electric circuit that is equivalent to the conductive layer of the slotted fixation roller of a fixing device when current is flowing in the circumferential direction of the fixation roller, in a manner to circumvent the slot through the adjacencies of the inward end of the slot.

Figure 14:
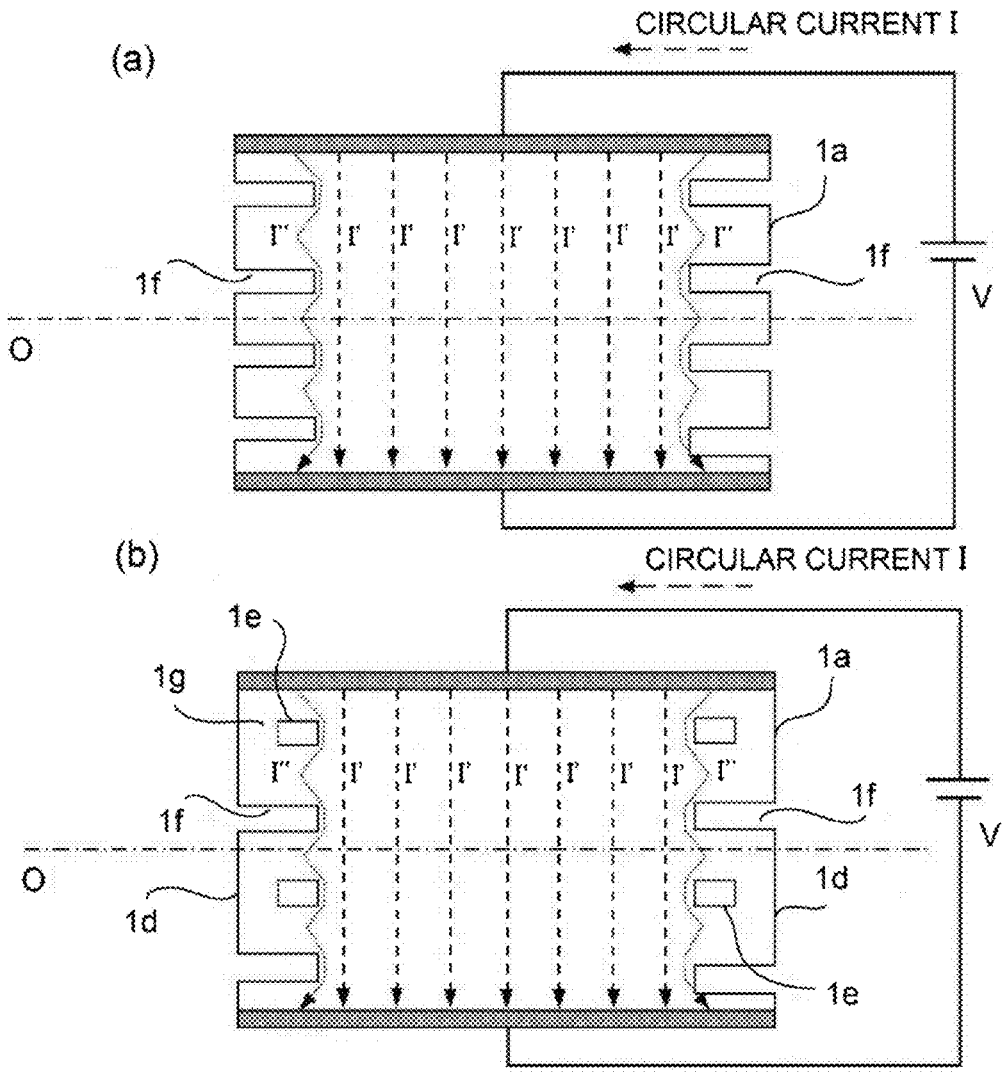

Part (a) of FIG. 14 is an electric circuit that is equivalent to the conductive layer of a fixation roller, the lengthwise end portions of which are provided with multiple slots, when current is flowing though the conductive layer in the circumferential direction of the fixation roller, and part (b) of FIG. 14 is an electric circuit that is equivalent to the conductive layer of the fixation roller, the lengthwise end portions of which are provided with a combination of slots and holes, when current is flowing through the conductive layer in the circumferential direction of the conductive layer.

Figure 15:
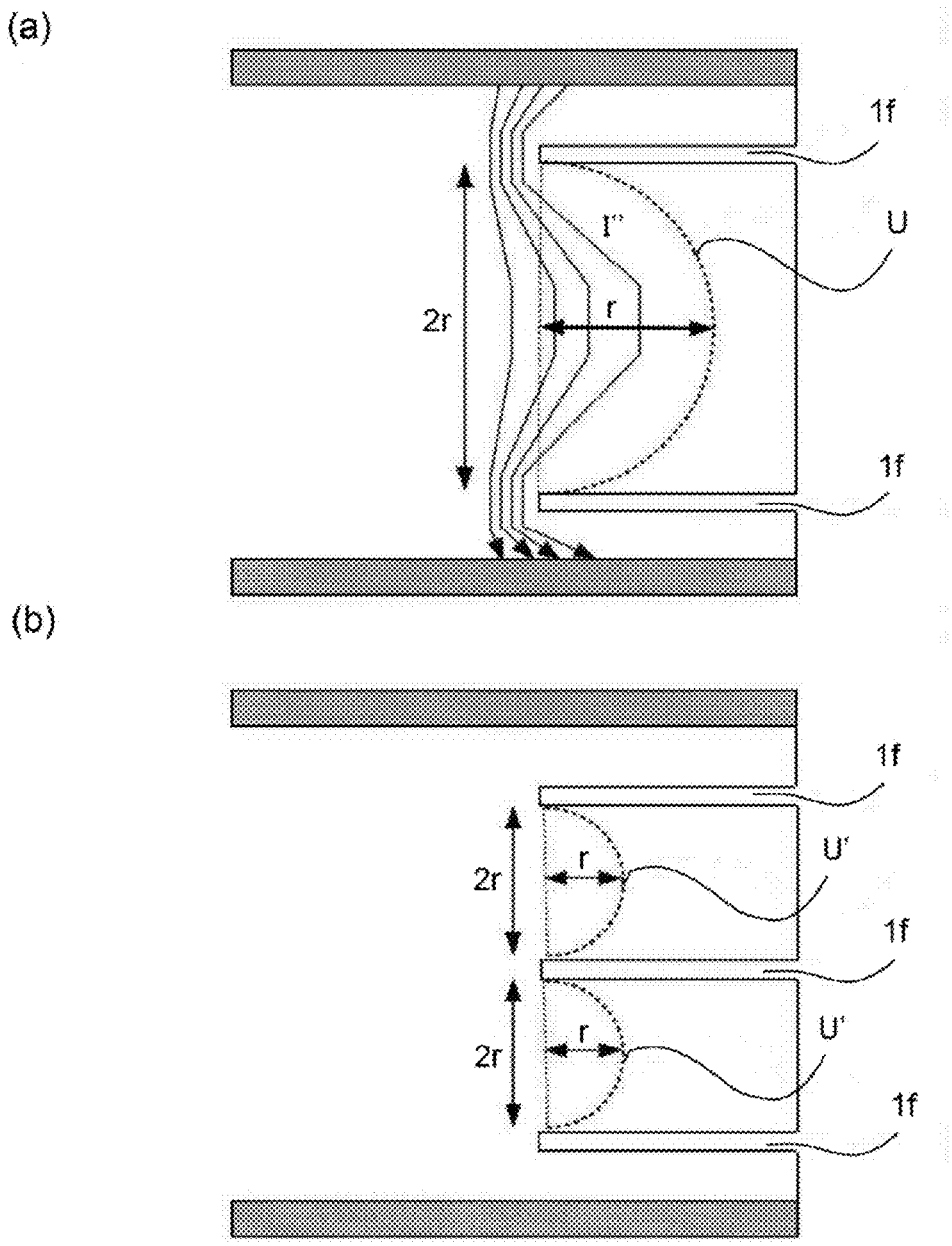

Parts (a) and (b) of FIG. 15 are drawings for describing the relationship between the circumventive current, and the area of the conductive layer, through which the circumventive current flows.

Figure 16:
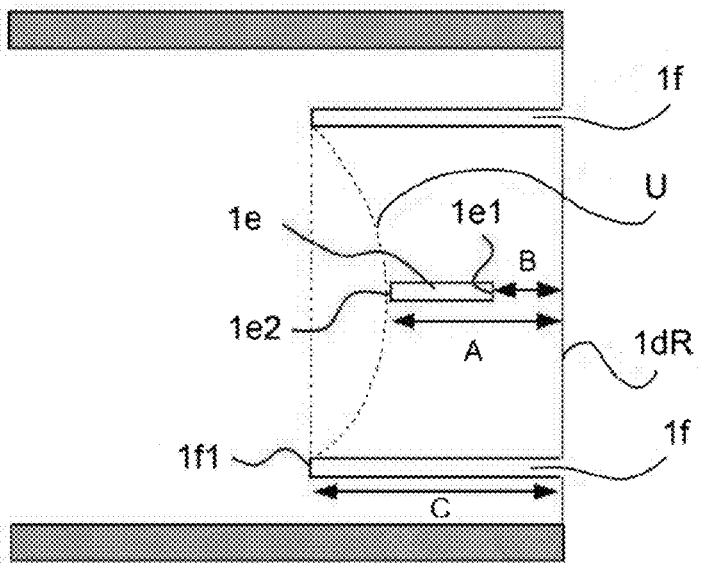
Figure 16:
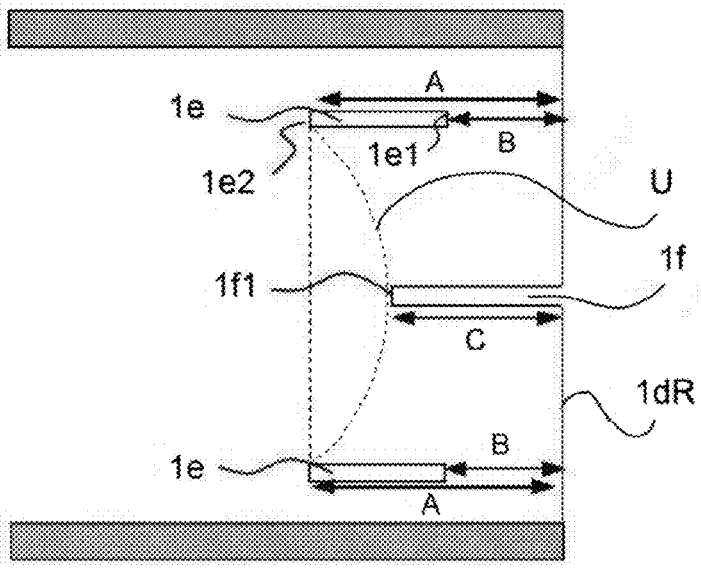

Parts (a) and (b) of FIG. 16 are drawings for describing the relationship between the positioning and shape of the holes and slots with which the lengthwise end portions of the fixation roller are provided, and the areas of the conductive layer, through which current flows to circumvent the slots and holes.

Figure 17:
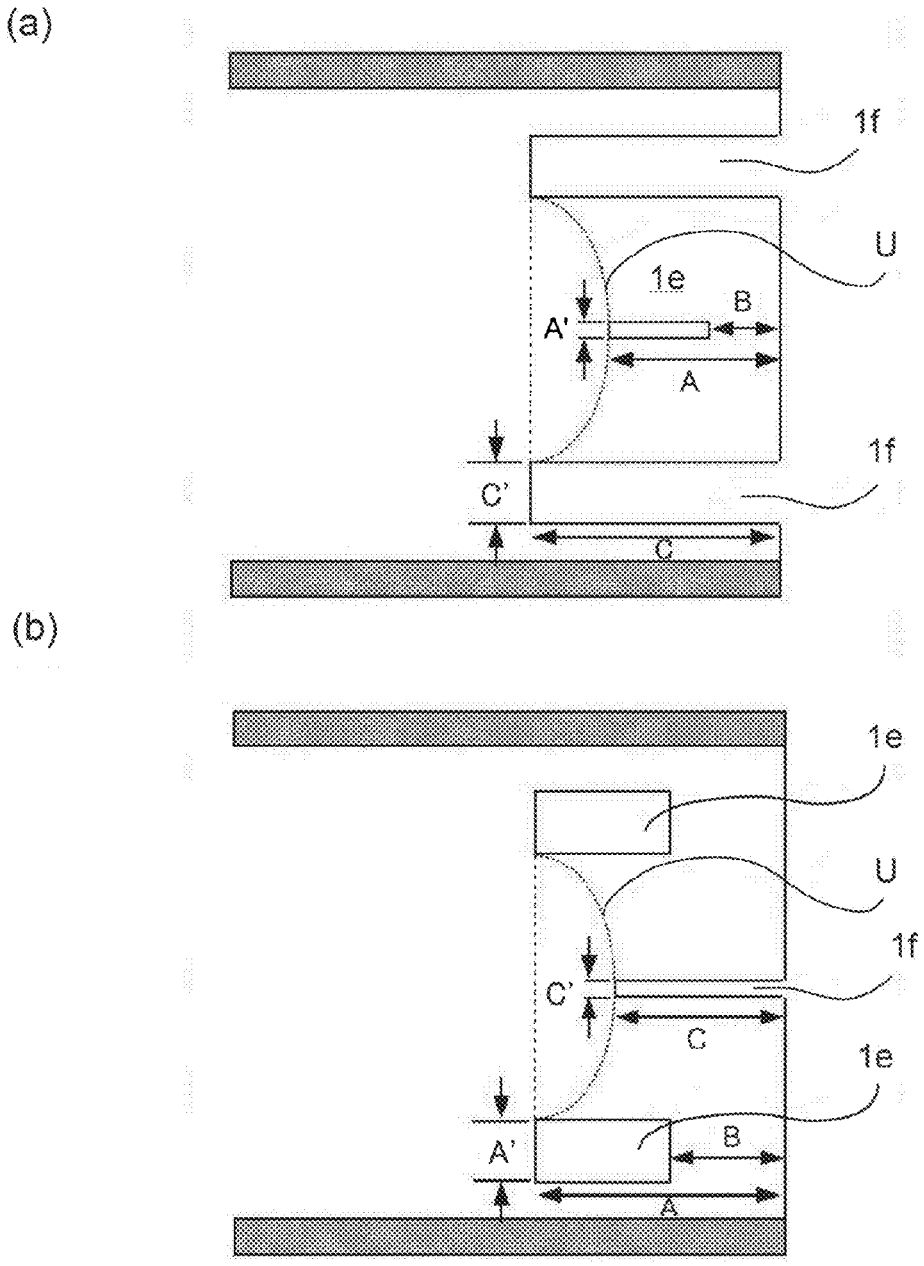

Parts (a) and (b) of FIG. 17 are drawings for describing the relationship between the shape and width of the slots and holes with which the lengthwise end portions of the fixation roller are provided, and the areas of the conductive layer, through which circumventive current flows.

DESCRIPTION OF THE EMBODIMENTS

Hereinafter, a few of the preferred embodiments of the present invention are described with reference to appended drawings. The following embodiments of the present invention are the most preferable embodiments of the present invention. However, these embodiments are not intended to limit the present invention in scope. That is, the present invention is also applicable to various known fixing devices and image forming apparatuses which are different in structure from those in the following embodiment, within the scope of the present invention.

Embodiment 1

(1) Image Forming Apparatus 100

Figure 1:
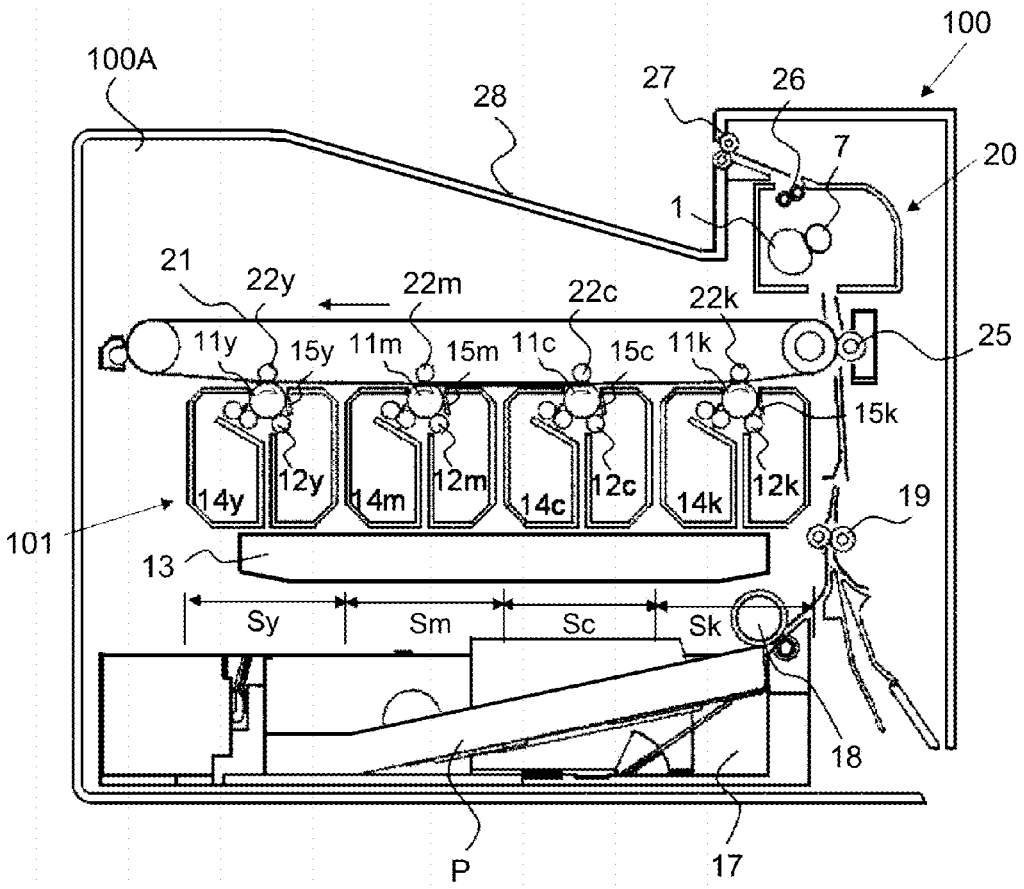
FIG. 1 is a sectional view of an example of image forming apparatus to which the present invention is applicable.

Referring to FIG. 1, an image forming apparatus equipped with an image heating device, as a fixing device, in accordance with the present invention is described. FIG. 1 is a sectional view of an image forming apparatus 100 (full-color printer) based on electrophotographic recording technologies. It shows the general structure of the apparatus.

An image forming portion 101 of the image forming apparatus 100, which is for forming a toner image on a sheet P of recording medium, has four image formation stations Sy, Sm, Sc, and Sk, which form yellow, magenta, cyan, and black toner images, respectively, on the sheet P.

Each image forming station Sy, Sm, Sc, and Sk has a photosensitive drum 11*y*, 11*m*, 11*c*, and 11*k*, respectively, as an image bearing and a charging member 12*y*, 12*m*, 12*c*, and 12*k*, respectively. Further, each image forming station Sy, Sm, Sc, and Sk has a laser scanner 13, a developing device 14*y*, 14*m*, 14*c*, and 14*k*, respectively, and a cleaner 15*y*, 15*m*, 15*c*, and 15*k*, respectively, which clean the photosensitive drums 11*y*, 11*m*, 11*c* and 11*k*, respectively. Moreover, each image forming station Sy, Sm, Sc, and Sk has a transferring member 22*y*, 22*m*, 22*c* and 22*k*, respectively, a belt 21, onto which toner images are transferred from the photosensitive drums 11*y*, 11*m*, 11*c*, and 11*k*, respectively, by the transferring members 22*y*, 22*m*, 22*c*, and 22*k*, respectively, and which conveys the transferred toner images thereon to a secondary transferring roller 25, which transfers the toner images onto the sheet P of recording medium from the belt 21.

The operation of the above described image forming portion 101 is well-known, and therefore, is not described here in detail.

Sheets P of recording medium stored in a recording medium cassette 17 in the main assembly 100A of the image forming apparatus 100 are fed one by one, into the main assembly 100A, by the rotation of a roller 18. Then, each sheet P is conveyed by the rotation of a pair of rollers 19 to a secondary transfer nip, which is the area of contact between the belt 21 and the secondary transfer roller 25. After the transfer of the toner images T onto the sheet P, the sheet P is sent to a fixing device 20 (fixing portion).

Then, the sheet P, which bears the unfixed toner images T, is heated by the fixing device 20, whereby the toner images T are fixed to the sheet P. After being conveyed out of the fixing device 20, the sheet P is discharged into a delivery tray 28 by the rotation of a pair of rollers 26 and the rotation of a pair of rollers 27.

(2) Fixing Device 20 (Image Heating Device)

2-1) General Structure

FIG. 2 is a sectional view of the fixing device 20 in this embodiment, which uses a heating method based on electromagnetic induction. It shows the general structure of the device 20. The fixing device 20 has a cylindrical fixation roller 1 as a cylindrical rotational member, a heating means H which comprises a combination of a magnetic core 2 and an excitation coil 3, which is for heating the fixation roller 1, and a pressure application unit 9 equipped with a pressure belt 7, as a nip forming member, which is pressed upon the fixation roller 1 to form a nip N.

The fixation roller 1 is rotatably supported. It is heated by the heating means H disposed in the hollow of the fixation roller 1. It is rotationally driven by an unshown motor in the direction indicated by an arrow mark by way of a driving gear 4. As for the pressure belt 7, it is rotated in the direction indicated by another arrow mark by the rotation of the fixation roller 1. A sheet P of recording medium, which bears unfixed toner images T, is heated in the nip N while being conveyed through the nip N, remaining pinched between the fixation roller 1 and the pressure belt 7. Consequently, the toner images T are fixed to the surface of the sheet P. Referring to FIG. 2, a referential code X stands for the direction in which the sheet P is conveyed.

There is no specific restriction regarding the shape and structure of the heating means H. All that is required of the heating means H is that it is shaped and structured so that it can be disposed in the hollow of the fixation roller 1. The choice of the heating means H may be made according to the purposes for which the heating means H is used. For example, a halogen lamp or the like may be chosen as the heating means H.

2-2) Fixation Roller 1 (Cylindrical Rotational Member)

Part (a) of FIG. 3 is a perspective view of a combination of the fixation roller 1 and the driving gear 4, when the fixation roller 1 and the driving gear 4 are separated. Part (b) of FIG. 3 is a sectional view of the fixation roller 1 showing the laminar structure of the fixation roller 1. Part (a) of FIG. 4 is an exploded perspective view of the combination of the fixation roller 1 and driving gear 4 showing how the driving gear 4 is attached to the fixation roller 1. Part (b) of FIG. 4 is an enlarged and exploded perspective view of a combination of the driving gear 4, and the lengthwise end portion of the fixation roller 1, to which the driving gear 4 is attached, and showing the shape of the keys (protrusions)

with which the driving gear 4 is provided, and the shape of slots (as key slots) with which the lengthwise end of the fixation roller 1 is provided to accommodate the keys (protrusions) of the driving gear 4 one for one.

Referring to part (b) of FIG. 3, the fixation roller 1 has a cylindrical conductive layer 1*a*, an elastic layer 1*b* formed on the peripheral surface of the conductive layer 1*a*, and a surface layer 1*c* (release layer) formed on a peripheral surface of the elastic layer 1*b*.

The conductive layer 1*a* is a piece of pipe having a thin wall (0.1 mm-1.0 mm in thickness), and is formed of austenitic stainless steel. As the material for the conductive layer 1*a*, a substance having such a specific resistance that can make the conductive layer 1*a* generate a sufficient amount of heat based on electromagnetic induction, should be selected. The elastic layer 1*b* is formed of such silicone rubber that is 20 degrees in hardness (JIS-A, under 1 kg of weight). It is 0.1 mm-0.8 mm in thickness. The surface layer 1*c*, as a release layer, is a piece of fluorine resin tube. It covers the elastic layer 1*b*, and is 10 μm-50 μm in thickness.

Referring to part (a) of FIG. 3, in terms of the lengthwise direction of the fixation roller 1, which is perpendicular to the recording medium conveyance direction X, the right end portion 1*a*R of the conductive layer 1*a*, which is on the outward side of the recording medium path A, is provided with multiple holes 1*e*, which are roughly evenly distributed in the circumferential direction of the conductive layer 1*a*. Further, the right end portion 1*a*R of the conductive layer 1*a* is provided with multiple slots 1*f*, which are also roughly evenly distributed in the circumferential direction of the conductive layer 1*a*, in such a manner that the slots 1*f* and the abovementioned holes 1*e* are alternately disposed in terms of the circumferential direction of the conductive layer 1*a*. Each slot 1*f* extends in the lengthwise direction of the conductive layer 1*a* from a right end 1*d*R of the conductive layer 1*a*, so that an inward end of the slot 1*f* aligns with an inward end of the adjacent holes 1*e* in terms of the circumferential direction of the conductive layer 1*a*. Here, the right end portion 1*a*R of the conductive layer 1*a* is the area between the right end 1*d*R of the conductive layer 1*a* and a right end 1*cl* of the surface layer 1*c*. That is, the right end portion 1*a*R is one of the out-of-sheet-path areas 1B.

Further, a left end portion 1*a*L of the conductive layer 1*a* (opposite end portion of the conductive layer 1*a* from the right end portion 1*a*R), which is on the outward side of the recording medium path A, is provided with multiple holes 1*e*, which are roughly evenly distributed in the circumferential direction of the conductive layer 1*a*. Further, the left end portion 1*a*L of the conductive layer 1*a* is provided with multiple slots 1*f*, which also are roughly evenly distributed in the circumferential direction of the conductive layer 1*a*, in such a manner that the slots 1*f* and the abovementioned holes 1*e* are alternately disposed in terms of the circumferential direction of the conductive layer 1*a*. Each slot 1*f* extends in the lengthwise direction of the conductive layer 1*a* from a left end 1*d*L of the conductive layer 1*a* so that an inward end of the slot 1*f* aligns with the inward end of the adjacent holes 1*e* in terms of the circumferential direction of the conductive layer 1*a*. Here, the left end portion 1*a*L of the conductive layer 1*a* is the area between the left end 1*d*L of the conductive layer 1*a* and a left end 1*cl* of the surface layer 1*c*. That is, the left end portion 1*a*L is also the out-of-sheet-path area 1B.

The holes 1*e* and the slots 1*f*, with which the right and left end portions 1*a*R and 1*a*L, respectively, of the conductive layer 1*a* are provided are shaped and disposed so that their lengthwise direction is perpendicular to the recording medium conveyance direction X.

Regarding the right and left end portions 1*a*R and 1*a*L of the conductive layer 1*a*, in this embodiment, they are each provided with four holes 1*e* and four slots 1*f*, which are 4.0 mm in width (dimension in terms of a direction perpendicular to the circumferential direction of the conductive layer 1*a*). Referring to part (a) of FIG. 3, therefore, the right and left end portions 1*a*R and 1*a*L of the conductive layer 1*a* are not contiguous in terms of the circumferential direction of the conductive layer 1*a*, except for the areas 1C, which are provided with neither the holes 1*e* nor the slots 1*f*. Here, the area 1C is the area of the conductive layer 1*a*, which is between the farthest lengthwise end 1*el* of a hole 1*e* from the right end 1*d*R, (or the farthest lengthwise end 1*fl* of a slot 1*f* from the right end 1*d*R of the conductive layer 1*a*), and the corresponding lengthwise end 1*cl* of the surface layer 1*c*.

The driving gear 4, as the driving member, is attached to the right end portion 1*a*R of the conductive layer 1*a* that the driving gear 4. The teeth portion 4*g* of the driving gear 4, which is on the outward side of the driving gear 4, meshes with the teeth portions of a gear by which the conductive layer 1*a* of the fixation roller 1 is rotationally driven. The driving gear 4 is a bevel gear. It is shaped so that as the driving gear 4 is rotationally driven, the driving force from the motor works on the driving gear 4 in a manner to press the driving gear 4 in the direction Ya, shown in part (a) of FIG. 4, which coincides with the axial line O of the conductive layer 1*a*. Therefore, as the driving force is transmitted to the driving gear 4, the conductive layer 1*a* shifts in position with the driving gear 4 in the direction parallel to the axial line O of the conductive layer 1*a* (fixation roller 1).

Next, the configuration of the fixation roller 1 and the driving gear 4, which is for attaching the driving gear 4 to the fixation roller 1, is described. Referring to part (a) of FIG. 3, the driving gear 4 is in the shape of a ring. That is, the driving gear 4 has a cylindrical hole 4*h* which is slightly larger in diameter than the external diameter of the conductive layer 1*a*. Therefore, the right end portion 1*a*R of the conductive layer 1*a* can be pushed into the cylindrical hole 4*h* of the driving gear 4. The inner surface of the driving gear 4 is provided with multiple claws 4*a* and multiple ribs 4*b*, which function like keys. These claws 4*a* and ribs 4*b* are positioned so that they can be aligned with the holes 1*e* and slots 1*f*, respectively, when the fixation roller 1 (conductive layer 1*a*) is inserted into the driving gear 4.

The driving gear 4 is attached to the fixation roller 1 in the following manner. First, the fixation roller 1 and driving gear 4 are positioned so that their rotational axes coincide, and the claws 4*a* and the ribs 4*b* align with the holes 1*e* and the slots 1*f*, respectively. Then, the driving gear 4 is to be fitted around the right end portion 1*a*R of the conductive layer 1*a* from the direction indicated by an arrow mark Y, in the direction parallel to the axial line O. Referring to part (a) of FIG. 4, during this process, the portion 1*g* of the right end portion 1*a*R of the conductive layer 1*a*, which is adjacent to each hole 1*e*, is to be kept flexed inward Rin in terms of the radial direction of the fixation roller 1 (conductive layer 1*a*). As each hole 1*e* and corresponding claw 4*a* coincide in terms of the direction parallel to the axial line O, the claw 4*a* fits into the corresponding hole 1*e*, allowing the portion 1*g* of the right end portion 1*a*R, which is adjacent to the hole 1*e*, to straighten.

In terms of the direction Ya in which the driving gear 4 is moved to be fitted around the conductive layer 1*a*, the position of the driving gear 4 is determined by the contact between the inward end 4b1 of the rib 4b near the right end portion 1aR of the conductive layer 1a, shown in part (b) of FIG. 4, and the farthest end 1fl of the slot 1f from the lengthwise right end 1dR of the conductive layer 1a. That is, in terms of the direction Ya in which the driving gear 4 is moved to be fitted around the conductive layer 1a, the rib 4b extends inward of the conductive layer 1a (fixation roller 1) from the lengthwise right end 1dR, far enough to come into contact with the farthest surface 1fl of the slot 1f from the lengthwise right end 1dR, as the driving gear 4 is moved in the direction Ya to be fitted around the conductive layer 1a.

In terms of the opposite direction from the direction Ya in which the driving gear 4 is moved to be fitted around the conductive layer 1a, a position of the driving gear 4 is determined by the contact between the opposite end 4a1 of the claw 4a from the right end 1dR of the conductive layer 1a, and the closest end 1el of the hole 1e from the right end 1dR. That is, in terms of the direction Ya in which the driving gear 4 is moved to be fitted around the conductive layer 1a, the claw 4a extends long enough to come into contact with the farthest end 1el of the hole 1e from the lengthwise end 1dR of the conductive layer 1a.

Thus, the multiple claws 4a and ribs 4b, with which the driving gear 4 is provided, fit into the multiple holes 1e and slots 1f, respectively, with which the right end portion 1aR of the conductive layer 1a are provided. Thus, the driving force from the motor is transmitted from the driving gear 4 to the conductive layer 1a by way of both the edges of these holes 1e and the edges of the slots 1f.

As described above, as the driving gear 4 is fitted around the right end portion 1aR of the fixation roller 1, the multiple claws 4a and multiple ribs 4b of the driving gear 4 fit into the corresponding holes 1e and slots 1f of the fixation roller 1, whereby the driving gear 4 is precisely positioned relative to the fixation roller 1 in terms of both the direction Ya in which the driving gear 4 is moved to be fitted around the fixation roller 1, and the opposite direction from the direction Ya. Therefore, the fixing device 20 in this embodiment is superior to any conventional fixing device, in terms of the accuracy in the positional relationship between the fixation roller 1 and driving gear 4 in terms of the lengthwise direction of the fixation roller 1. Further, in terms of the direction Ya in which the driving gear 4 is moved to be fitted around the fixation roller 1, the area of contact between the edge of the hole 1e of the fixation roller 1, and the claw 4a, and the area of contact between the edge of the slot 1f of the fixation roller 1, through which the driving force is transmitted from the driving gear 4 to the fixation roller 1 remain the same in position in terms of the direction Ya. Therefore, the amount of the stress to which the edge of the hole 1e and the edge of the slot 1f of the fixation roller 1 are subjected as the driving force is transmitted to the fixation roller 1 remains stable. Therefore, right end portion 1aR of the conductive layer 1a is unlikely to be damaged by the stress.

Table 1 shows results of tests (simulations) carried out to measure the maximum amount of stress to which the fixation roller 1 is subjected as driving force is transmitted to the fixation roller 1 from the driving gear 4. More specifically, Table 1 shows the calculated results of the analysis of the simulations (tests), in terms of an elasticity-plasticity analysis, regarding a large amount of deformation/limited slippage.

TABLE 1

| | Number of engaging claws | Number of engaging protrusions | Max. stress of roller [MPa] |
|---|---|---|---|
| Conventional structures | 0 | 8 | 315 |
| Embodiment | 4 | 4 | 230 |

Referring to Table 1, compared to a comparative example of a fixing device (i.e., a conventional structure), which is structured so that driving force is transmitted to the fixation roller 1 by only the ribs 4b of the driving gear 4, the fixing device 20 in this embodiment is smaller in the amount of the stress to which the fixation roller 1 is subjected. By the way, the results given in Table 1 are those which are obtainable only when the areas of contact between the fixation roller 1 and driving gear 4 are stable in position in terms of the lengthwise direction of the fixation roller 1. In comparison, the comparative example of fixing device, which relies only on the ribs to transmit driving force, is unstable in the position of the areas of contact between the ribs of the driving gear 4 and the fixation roller 1 in terms of the lengthwise direction of the fixation roller 1. Therefore, the comparative fixing device is substantially larger in the maximum amount of stress to which the fixation roller 1 is subjected as a driving force is transmitted to the fixation roller 1.

In this embodiment, in a case in which the fixing device 20 is structured so that the four holes 1e and the four slots 1f are evenly distributed in the circumferential direction of the fixation roller 1, and the holes 1e and the slots 1f are alternately positioned in terms of the circumferential direction of the fixation roller 1, the amount of the stress to which the fixation roller 1 is subjected when a driving force is transmitted from the driving gear 4 to the fixation roller 1 is smallest. However, the best shape for the holes 1e and the slots 1f, and the positioning of the holes 1e and the slots 1f, are affected by the material, size, and wall thickness of the fixation roller 1. Therefore, the shape and positioning of the holes 1e and the slots 1f are desired to be determined based on the structure of the fixation roller 1.

In this embodiment, the driving force is transmitted to the fixation roller 1 by the multiple claws 4a and multiple ribs 4b with which the driving gear 4 is provided. However, effects similar to those obtained by this embodiment can be obtained even if the driving gear 4 is provided with no rib 4b, or the number of the ribs 4b is different from the number of the holes 1e with which the fixation roller 1 is provided.

Shown in FIG. 6 is an example of modified version of the combination of the fixation roller 1 and the driving gear 4. In this embodiment, the driving gear 4 is fitted around the outward side of the right end portion 1aR of the conductive layer 1a of the fixation roller 1. However, the combination may be structured so that a part of the driving gear 4 is inserted into the right end portion 1aR of the conductive layer 1a of the fixation roller 1, as shown in FIG. 6. In the case of this example modification, the driving gear 4 is provided with a cylindrical supporting portion 4s for supporting the right end portion 1aR of the conductive layer 1a of the fixation roller 1, and this cylindrical supporting portion 4s is inserted into the right end portion 1aR of the conductive layer 1a in such manner that the multiple claws 4a and the multiple ribs 4b fit into the holes 1e and the slots 1f of the fixation roller 1, respectively.

In this embodiment, the fixing device 20 is structured so that the driving gear 4 is attached to the fixation roller 1.

However, the application of the present invention is not limited to a cylindrical rotational member to a fixation roller such as the fixation roller 1 in this embodiment. That is, the present invention is applicable to any cylindrical rotational member having a thin wall.

Next, the opposite lengthwise end portion 1*a*L (which hereafter will be referred to as "not-driven end portion") of the fixation roller 1 from the one fitted with the driving gear 4, that is, the lengthwise end portion 1*a*R (which hereafter will be referred to as "driven end portion") of the fixation roller 1, from which the fixation roller 1 is not driven, is described.

The fixation roller 1 is roughly symmetrical with reference to its lengthwise center. That is, the not-driven end portion 1*a*L of the fixation roller 1 is provided with holes 1*e* and slots 1*f* as is the driven end portion 1*a*R. This setup is for equalizing the driven end portion 1*a*R and not-driven end portion of the fixation roller 1 in the manner in which heat is generated therein by electromagnetic induction, which is described later. By equalizing the two end portions 1*a*R and 1*a*L in the manner of heat generation, it is possible to minimize the amount by which heat is generated in the driven end portion 1*a*R and not-driven end portion 1*a*L, which are out-of-sheet-path portions of the fixation roller 1.

To the not-driven end portion 1*a*L, a round cap 5 is attached as a capping member. Shown in FIG. 5 are the keys, with which the cap 5 is provided and, the key slots with which the not-driven end portion 1*a*L of the fixation roller 1 is provided.

At a center of the cap 5, a cylindrical hole 5*h* is provided, which is coaxial with the cap 5 and the diameter of which is slightly larger than the external diameter of the conductive layer 1*a*. The cap 5 is structured so that multiple ribs 5*a*, which are formed on an inner surface of the cap 5 and are shaped like a key, fit into the multiple slots 1*f*, one for one, with which the not-driven end portion 1*a*L of the fixation roller 1 is provided. The cap 5 is attached to the not-driven end portion 1*a*L in such a manner that it is allowed to slide in the direction parallel to the axial line O of the fixation roller 1 to be easily attached to, or unattached from, the fixation roller 1, because, if the cap 5 cannot be removed, the space through which the components to be placed in the hollow of the fixation roller 1 during the assembly of the fixation roller 1 will be smaller.

Unlike the driving gear 4, the cap 5 is not given the function of transmitting a large amount of driving force (torque). Therefore, it is unlikely that the fixation roller 1 is damaged by the stress to which the fixation roller 1 is subjected as the fixation roller 1 is rotated.

The cap 5 is attached to the fixation roller 1 in the following manner. First, the cap 5 is positioned so that the keys 5*a* are aligned with the key slots 1*f* of the not-driven end portion 1*a*L of the fixation roller 1. Then, the cap 5 is fitted around the not-driven end portion 1*a*L in the direction indicated by an arrow mark Yb which is parallel to the axial line O of the fixation roller 1. The position of the cap 5 relative to the fixation roller 1 in terms of the direction in which the cap 5 is moved to be fitted around the not-driven end portion 1*a*L is determined by the contact between the downstream end (surface) 5*al* of the rib 5*a* in terms of the direction in which the cap 5 is moved to be fitted around the not-driven end portion 1*a*L, and the farthest end 1*fl* of the slot 1*f* from the lengthwise end 1*d*L of the fixation roller 1. That is, in terms of the direction Yb in which the cap 5 is moved to be fitted around the not-driven end portion 1*a*L, each rib 5*a* is long enough to extend from the lengthwise end 1*d*L to come into contact with the farthest end 1*fl* of the corresponding slot 1*f* from the lengthwise end 1*d*L.

2-3) Pressure Belt Unit 9

Referring to FIG. 2, the pressure belt unit 9 has a pressure belt 7, which is an endless belt and which is rotated by the rotation of the fixation roller 1. There is disposed a pressure pad 8 on the inward side of the loop which the pressure belt 7 forms. The pressure pad 8 contacts the inward surface of the pressure belt 7. It is supported by a rigid supporting member 6*b*, which is U-shaped in cross section. It presses on the fixation roller 1 from the inward side of the pressure belt loop, with the presence of the pressure belt 7 between itself and the fixation roller 1.

The pressure belt 7 does not need to be laminar. In this embodiment, however, a laminar endless belt, which has a substrative layer, and a release layer formed on the surface of the substrative layer, is used as the pressure belt 7. As the material for the substrative layer, a heat resistant substance such as thermally curable polyimide, thermoplastic polyimide, polyamide, polyamideimide, and the like is used. As for the material for the release layer, a substance, to which toner is unlikely to remain adhered, is desirable. For example, fluorine resin such as PTFE (polytetrafluoroethylene), PFA (tetrafluoroethylene-perfluoroalkoxylethylene copolymer) is used.

The primary role of the pressure pad 8 is to make the fixation roller 1 and pressure belt 7 form a nip N between them. As the material for the pressure pad 8, a rigid substance such as metal, more specifically, aluminum, stainless steel, steel, copper, brass, etc., their alloys, or resins, which are highly rigid are primarily used. In this embodiment, a pad formed of liquid polymer by injection molding and reinforced by glass fiber was used as the pressure pad 8. Therefore, it is ensured that the pressure pad 8 in this embodiment is provided with a proper amount of rigidity in terms of the direction perpendicular to the lengthwise direction of the nip N.

2-4) Structure of Heating Means H

FIG. 7 is a sectional view of a combination of the fixation roller 1 and the heating means H disposed in the hollow of the fixation roller 1. FIG. 8 is a perspective cutaway view of the fixation roller 1, and shows a part of the heating means H.

As noted herein, the heating means H has the magnetic core 2 and the excitation coil 3. The magnetic core 2 is cylindrical and is disposed roughly at the center of the hollow of the fixation roller 1, being held by an unshown fixing means. The role of the magnetic core 2 is to guide the magnetic flux of the alternating magnetic field, generated by the excitation coil 3, into the inward side of the conductive layer 1*a* (area between conductive layer 1*a* and the magnetic core 2). That is, the magnetic core 2 forms a passage (magnetic passage) for the magnetic flux.

As the material for the magnetic core 2, a substance, such as ferrite made by sintering, and ferrite resin, amorphous metallic alloy, which is small in hyteresis loss, and high in relative magnetic permeability, or a ferromagnetic substance, such as Permalloy® or the like oxide (which is high in magnetic permeability), is desirable. In particular, in a case in which a high frequency alternating current, that is, an alternating current which is 21 kHz-100 kHz in frequency, is flowed through the excitation coil 3, ferrite which is made by sintering and is small in loss when high frequency alternating current is flowed, is desirable.

The magnetic core 2 is desired to be as large as possible in cross section, as long as it can be disposed in the hollow of the conductive layer 1*a*. In this embodiment, the magnetic core 2 is 5 mm-40 mm in diameter, and 230-300 mm in length in terms of the direction perpendicular to the recording medium conveyance direction X. By the way, it is not mandatory that the magnetic core 2 is in the form of a piece of round column. It may be in the form of a piece of column which is polygonal in cross section.

The excitation coil 3 is formed by spirally winding copper wire (single wire) which is coated with heat resistant polyamide and 0.5-2.0 mm in diameter, around the magnetic core 2 roughly 10-100 times. It has a spiral portion 3*a*, the axial line of which is roughly parallel to the generatrix of the fixation roller 1. In this embodiment, the excitation coil 3 is wound 16 times. The excitation coil 3 is wound in the direction which is intersectional to the axial line of the fixation roller 1. Therefore, as high frequency alternating current is flowed through the excitation coil 3, an alternating magnetic field which is parallel to the axial line of the conductive layer 1*a* is generated.

(3) Heat Generation Principle of Heating Means H (3-1) Shape of Magnetic Field

The fixing device 20 is provided with the combination of the spiral excitation coil 3 and the magnetic core 2, which are disposed in the hollow of the fixation roller 1, like the fixing device disclosed in Japanese Laid-open Patent Application No. 2014-26267. The excitation coil 3 is disposed in such an attitude that its lengthwise direction is parallel to the axial line of the fixation roller 1. The magnetic core 2 is for guiding the magnetic flux. It is disposed inside the excitation coil 3 to guide the magnetic flux generated by the excitation coil 3 in such a manner that the magnetic flux does not go through the conductive layer 1*a* of the fixation roller 1.

That is, the primary objective of this embodiment is to create the following state, which may be deemed as an index that indicates how easily magnetism goes through the fixation roller 1 in the lengthwise direction of the fixation roller 1, looking at the fixing device 20 as a magnetic circuit. That is, the primary objective of this embodiment is to create such a state that the "the magnetic core 2 is small enough in magnetic resistance in terms of its lengthwise direction, and the conductive layer 1*a* and the inward adjacencies of the conductive layer 1*a* are large enough in magnetic resistance". With the creation of this state, it is possible to provide a fixing device designed so that the magnetic flux concentrates in the magnetic core 2, and does not go through the conductive layer 1*a* and the inward adjacencies of the conductive layer 1*a*.

As alternating current is flowed through the excitation coil 3, the conductive layer 1*a* is subjected to such electromagnetic force that induces electric current in the circumferential direction of the conductive layer 1*a*. Thus, heat (Joule's heat) is efficiently generated by this current which flows in the circumferential direction of the conductive layer 1*a*. Unlike the method disclosed in Japanese Laid-open Patent Application No. 2000-81806, this method of generating heat in the conductive layer 1*a* does not require that the magnetic flux is guided to the conductive layer 1*a*. Therefore, it is meritorious in that it is relatively small in the amount of restriction regarding the thickness and material of the conductive layer 1*a*.

3-2) Heat Generation Principle of Conductive Layer 1*a* Having No Slot 1*f*

Next, the heat generation principle of the conductive layer 1*a* having no slot 1*f* is described.

Referring to part (a) of FIG. 9, the heat generation mechanism of the conductive layer 1*a* is described. The magnetic flux generated by flowing alternating current through the coil 3 permeates through the magnetic core 2 which is in the hollow of the cylindrical conductive layer 1*a* in the direction (S-to-N direction) parallel to the axial line O of the conductive layer 1*a*, comes out of the conductive layer 1*a* from one end (N) of the lengthwise ends of the magnetic core 2, and returns to the other end (S). Thus, current is induced in the direction to counter the fluctuation (increase and decrease) of the magnetic flux which is permeating through the conductive layer 1*a* in the direction parallel to the axial line O of the conductive layer 1*a*. Consequently, the current flows through the conductive layer 1*a* in the circumferential direction of the conductive layer 1*a*, generating heat (Joule's heat) in the conductive layer 1*a*. That is, heat is generated in the conductive layer 1*a* by electromagnetic induction.

The amount of this current-inducing electric power (V), which is generated in the conductive layer 1*a*, is proportional to the amount ($\Delta\varphi/\Delta t$) by which the magnetic flux fluctuates per unit length of time while permeating through the conductive layer 1*a*, and the number N of windings of the magnetic coil 3, as expressed by the following Equation (1).

$$V = -N\frac{\Delta\Phi}{\Delta t} \tag{1}$$

There is a correlation between the ratio of the magnetic fluxes which take the outside route, relative to the entirety of the magnetic fluxes which come out of one of the lengthwise ends of the magnetic core 2, and the amount (electric power conversion efficiency) by which the electric power inputted into the coil 3 is consumed for the heat generation in the conductive layer 1*a*. Thus, the amount by which the electric power inputted into the coil 3 is consumed for the heat generation is a very important parameter. The greater the ratio of the magnetic fluxes which take the outside route, the higher the ratio with which the electric power inputted into the coil 3 is consumed for the heat generation in the conductive layer 1*a* (higher the power conversion efficiency). The reason for the occurrence of this phenomenon is the same in principle as the phenomenon that, provided that a transformer is negligibly small in magnetic flux leakage, the transformer is higher in power conversion efficiency if the number of magnetic fluxes which pass through the primary coil of the transformer is equal to the number of magnetic fluxes which pass through the secondary coil.

That is, in the case of this embodiment, the closer the number of magnetic fluxes which pass through the core 2 to the number of magnetic fluxes which take the outside route, the higher the fixation roller 1 is in power conversion efficiency. That is, the high frequency current which flows through the coil 3 can be efficiently converted into a current that flows through the conductive layer 1*a* in the circumferential direction of the conductive layer 1*a*, for the following reason.

That is, referring to part (a) of FIG. 9, the magnetic fluxes which pass through the core 2 are opposite in direction from the magnetic fluxes which take the inside route. Thus, if the number of the magnetic fluxes on the inward side, inclusive of the magnetic core 2, of the cylindrical conductive layer 1*a* is the same as the number of the magnetic fluxes on the outward side of the cylindrical conductive layer 1*a*, these magnetic fluxes cancel each other out. Thus, the number of magnetic fluxes which pass through the entirety of the inward side of the conductive layer 1*a* from S to N is reduced, thus reducing the changes which occur to the magnetic field per unit length of time. As the magnetic field reduces in the amount of change per unit length of time, the amount by which current is induced in the conductive layer 1*a* reduces, which results in a reduction in the amount by which heat is generated in the conductive layer 1*a*.

It is evident from foregoing description that it is important for the fixing device 20 to be controlled in the ratio of the magnetic fluxes which take the outside route, in order to achieve a desired power conversion ratio.

It is not mandatory that the magnetic core 2 is in the form of a piece of round column. For example, the magnetic core 2 may be in the form of a rectangular frame, a section of which is put though the hollow of the conductive layer 1*a* as shown in part (b) of FIG. 9.

3-3) Circuit Equivalent in Current Flow to Conductive Layer of Fixation Roller 1

Part (a) of FIG. 10 is a perspective view of the slot-less conductive layer 1*a*. According to the structure of the heating means H in this embodiment, as the conductive layer 1*a* is subjected to a power generating force, which works in the circumferential direction of the conductive layer 1*a*, a current I flows in the conductive layer 1*a* in the direction indicated by the arrow marks. Part (b) of FIG. 10 is a circuit which is equivalent to a circuit created by flattening the cylindrical conductive layer, such as 1*a* by cutting the conductive layer 1*a* in the direction parallel to the axial line O of the conductive layer 1*a*, and applying a DC voltage between the two edges created by the cutting. In this case, an overall amount of resistance R of the conductive layer 1*a* can be expressed in the form of the following Equation (2), in which L, θ, d and p stand for the length of the conductive layer 1*a* in terms of the direction parallel to the axial line O of the conductive layer 1*a*, a circumference of the conductive layer 1*a*, a thickness of the conductive layer 1*a*, and an electrical resistivity of the conductive layer 1*a*, respectively.

$$R = \frac{\theta}{Ld}\rho \tag{2}$$

Therefore, if the conductive layer 1*a* in part (b) of FIG. 10 is subjected to the power generating force V, the overall amount W by which heat is generated in the conductive layer 1*a*, and the amount w by which heat is generated in conductive layer 1*a* per unit volume of the conductive layer 1*a*, can be calculated by the following Equations (3) and (4), respectively.

$$W = \frac{V^2}{R} = \frac{Ld}{\theta}\frac{V^2}{\rho} \tag{3}$$

$$\omega = \frac{W}{\theta Ld} = \frac{1}{\theta^2}\frac{V^2}{\rho} \tag{4}$$

3-4) Principle Based on which Slots Prevent Heat from being Excessively Generated in Conductive Layer Next, the principle based on which heat is generated in conductive layer 1*a* of fixation roller 1, which has slots 1*f*, is described.

3-4-1) Principle Based on which Slots Prevent Heat from Excessively Generated in Conductive Layer Next, regarding a fixing device, like the fixing device 20 in this embodiment, the fixation roller 1 of which is heated by the heat generated therein by the current which flows through its conductive layer 1*a* in the circumferential direction of the fixation roller 1, the principle based on which the distribution of slots across the lengthwise end portions of the fixation roller 1 in terms of the circumferential direction of the fixation roller 1 prevents the lengthwise end portions from being excessively heated, is described with the use of the calculation made with reference to an electrical circuit equivalent in current flow to the fixation roller 1, by comparing a fixation roller, the cylindrical conductive layer 1*a* of which has slots and a fixation roller, the cylindrical conductive layer 1*a* of which does not have slots.

Part (a) of FIG. 11 is a schematic perspective view of a cylindrical conductive layer 1*a* of the fixation roller 1, shown in part (a) of FIG. 10, which has only one slot 1*f*. As the conductive layer 1*a* structured as shown in part (a) of FIG. 10 is subjected to the power generating force V which works in the circumferential direction of the conductive layer 1*a*, current I' flows through the conductive layer 1*a* in the direction indicated by the arrow marks in part (a) of FIG. 11. Part (b) of FIG. 11 is a drawing of an electrical circuit that is equivalent in current flow to the circuit made by flattening the conductive layer 1*a*, for example, by cutting the conductive layer 1*a* in the direction parallel to the axial line O of the conductive layer 1*a* and attaching a power generating means to the flattened rotational member power so that a DC voltage is applied between the two edges of the flattened rotational member 1*a*, which are parallel to the rotational axis of the conductive layer 1*a*.

Referring to part (b) of FIG. 11, "a" stands for the dimension (depth) of the slot 1*f* in terms of the direction parallel to the axial line of the conductive layer 1*a*, and "b" stands for the dimension (width) of the slot 1*f* in terms of the circumferential direction of the conductive layer 1*a*. It is reasonable to suppose that the flattened conductive layer 1*a* comprises five zones (areas) A-E. If it is assumed here that the five zones A-E have electrical resistances RA-RE, and also, that it is only the current which flows through the conductive layer 1*a* in the circumferential direction of the conductive layer 1*a* that contributes to the heat generation in the conductive layer 1*a*, part (b) of FIG. 11 can be approximately redrawn as the electrical circuit shown in FIG. 12. The overall amount R' of electrical resistance of the conductive layer 1*a* in FIG. 12 is expressible in the form of Equation (5).

$$R' = \frac{R_A R_D}{R_A + R_D} + R_B + \frac{R_C R_E}{R_C + R_E} \tag{5}$$

In the case of the conductive layer 1*a* shown in part (a) of FIG. 11, the number of the slot 1*f* is only one. Therefore, if it is assumed here that the slot 1*f* is at the center of the conductive layer 1*a* in terms of the circumferential direction of the conductive layer 1*a*, the electrical resistances RA-RE are expressible in the form of the following equations (6)-(8).

$$R_A = R_C = \frac{\theta - b}{2(L-a)d}\rho \tag{6}$$

$$R_B = \frac{b}{(L-a)d}\rho \tag{7}$$

$$R_D = R_E = \frac{\theta - b}{2ad}\rho \tag{8}$$

By substituting RA-RE in Equation (5) with Equations (6)-(8), R' can be simplified as Equation (9).

$$R' = \frac{(L-a)\theta + ab}{(L-a)Ld}\rho \tag{9}$$

Therefore, the amount by which heat is generated by the overall amount R' of electrical resistance in FIG. 12, that is, the overall amount W by which heat is generated in the conductive layer 1*a* as the conductive layer 1*a* in part (b) of FIG. 11 is subjected to the power generating force V is expressed in the form of Equation (10).

$$W' = \frac{V^2}{R'} = \frac{(L-a)Ld}{(L-a)\theta + ab}\frac{V^2}{\rho} \tag{10}$$

There is the following relationship, expressible in the form of Expression (11), between the amount W' (Equation (10)) by which heat is generated in the conductive layer 1*a* having the slot 1*f* and the amount W (Equation 3) by which heat is generated in the conductive layer 1*a* having no slot, provided that both conductive layers 1*a* are subjected to the same amount of power generating force V.

$$\frac{W'}{W} = \frac{(L-a)\theta}{(L-a)\theta + ab} < 1 \ (\because ab > 0) \tag{11}$$

Based on Expression (11), W'<W. Thus, it is proven that the presence of the slot 1*f* can prevent the generation of an unnecessary amount of heat.

3-4-2) Principle of Excessive Amount of Heat Generation in Adjacencies of Inward End of Slot 1*f* of Conductive Layer 1*a*

In the case of an electrical circuit such as the one shown in part (b) of FIG. 11, the presence of the slot 1*f* reduces the overall amount by which heat is generated in the conductive layer 1*a*. On the other hand, the presence of the slot 1*f* causes the current generated in the zones D and E to circumvent the slot 1*f*. That is, the presence of the slot 1*f* generates current I" which flows through the right end portion of the zone B. Therefore, the right end portion (adjacencies of an inward end of the slot 1*f*) of the zone B increases in the amount of current, and therefore, increases in the amount by which heat is generated therein. If the amount by which heat is generated in the right end portion of the zone B becomes substantial, it will possibly lead to problems, such as the damage to the fixation roller 1, and in particular, damage to the key portions of the fixation roller 1.

(4) Method which Relies on Shape and Positioning of Slot to Prevent Adjacencies of Inward End of Slot from Generating Heat Referring to part (a) of FIG. 14, cutting multiple slots 1*f* in the lengthwise end portions of the conductive layer 1*a* in such a pattern that the slots 1*f* distributed in the circumferential direction of the conductive layer 1*a* can effectively reduce the amount by which the current I" (which hereafter will be referred to as circumventive current) is generated in a manner to circumvent (detour around) the slots 1*f*. Therefore, it can prevent the problem that the fixation roller 1 is damaged by the excessively large amount of heat generated by the excessively large amount of current generated in the adjacencies of the inward ends of the slots 1*f*.

The greater the number of slots 1*f*, the more effectively the current is prevented from being generated in a manner to circumvent the slot 1*f* through the adjacencies of the inward end of each slot 1*f*. However, the greater the number of slots 1*f*, the weaker the lengthwise end portions of the fixation roller 1 become. Besides, as rotational force is transmitted from the driving gear 4 to one of the lengthwise ends of the fixation roller 1, this force works in a manner to widen the slots 1*f*. Therefore, increasing the lengthwise end portions of the fixation roller 1 in the number of slots 1*f* is problematic in that the greater the number of slots 1*f*, the weaker the lengthwise end portions of the fixation roller 1, and therefore, the more likely it is for the fixation roller 1 to be damaged by the driving force from the driving gear 4.

4-1) Method for Minimizing Amount by which Adjacencies of Slots 1*f* are Reduced in Mechanical Strength Referring to part (b) of FIG. 14, one of the methods for preventing the above described problem is to provide the lengthwise end portions of the conductive layer 1*a* with a combination of multiple slots 1*f*, the long edges of which are parallel to the axial line O of the conductive layer 1*a*, and multiple elongated holes 1*e*, the long edges of which are parallel to the axial line O of the conductive layer 1*a*, and position the slots 1*f* and the holes 1*e* so that they are alternately and evenly distributed in the circumferential direction of the conductive layer 1*a*.

With the fixation roller 1 being structured as described above, it is possible to effectively prevent the occurrence of the "circumventive current", while minimizing the amount by which the is adjacencies of the inward end of the slots 1*f* are reduced in strength by the structural arrangement for the prevention of the occurrence of the "circumventive current". From the standpoint of reducing the occurrence of the "circumventive current", this structural arrangement is as effective as eight slots 1*f*. That is, in the case of this structural arrangement, the adjacencies of each hole 1*e* of the conductive layer 1*a* is contiguous with the right end 1*d*R. Thus, it is meritorious in that it provides the lengthwise end portions of the conductive layer 1*a* with a sufficient amount of mechanical strength.

Further, as described above, this structural arrangement can improve the fixing device 20 in accuracy in terms of the positional relationship between the fixation roller 1 and the driving gear 4 in terms of the lengthwise direction of the fixation roller 1. Therefore, it can ensure that in terms of the direction in which the claws 4*a* and the ribs 4*b* of the driving gear 4 are inserted into the holes 1*e* and the slots 1*f* of the fixation roller 1, respectively, the position at which the driving force is transmitted from the driving gear 4 to the fixation roller 1 always remains the same. Therefore, the amount of the stress, to which the edge of each hole 1*e* of the fixation roller 1 is subjected, remains stable. Therefore, this structural arrangement can prevent the driven end portion 1*a*R of the fixation roller 1 from being damaged by the stress.

Further, the fixing device 20 is structured so that while the fixation roller 1 is rotationally driven by the driving gear 4, which is a bevel gear, the fixation roller 1 remains pressed toward the driving gear 4. Therefore, the fixing device 20 remains stable in the positional relationship among the fixation roller 1, the core 2, and the coil 3 in terms of the lengthwise direction of the fixing device 20. Therefore, the driven end portion 1*a*R and not-driven end portion 1*a*L of the fixation roller 1, which are the out-of-sheet-path portions B of the lengthwise end portions of the fixation roller 1, remain the same in the state of heat generation. That is, this embodiment (present invention) can simplify the means for preventing the out-of-sheet path portions of the fixation roller 1 from becoming excessively high in temperature and/or nonuniform in temperature.

Therefore, even if a piece of metallic cylinder, which is thin, and therefore, is small in thermal capacity, is used as the conductive layer 1*a* for a fixation roller 1, it is possible to realize such a fixation roller 1 that, the lengthwise end portions of which are shaped so that they are not damaged by a large amount of torque the adjacencies of the inward end of the slot (key slot) are not overheated by the concentration of current thereto, and the out-of-sheet-path portions B are minimized in the amount of heat generation. Therefore, it is possible to provide an image forming apparatus 100 which requires a significantly shorter length of time to warm up, and smaller in power consumption than any conventional image forming apparatus, by installing the fixing device 20 equipped with the fixation roller 1 in this embodiment, in the apparatus 100.

Embodiment 2

In the first embodiment, the lengthwise end portions of the conductive layer 1*a* are provided with the multiple elongated holes 1*e* and multiple elongated slots 1*f*, the lengthwise edges of which are parallel to the axial line O of the conductive layer 1*a*, and which are alternately and roughly evenly distributed in the circumferential direction of the conductive layer 1*a*. Therefore, it was possible to minimize the amount of the current which circumvent the holes 1*e* and slots 1*f*, while minimizing the amount by which the lengthwise end portions of the conductive layer 1*a* are reduced in mechanical strength by the provision of the holes 1*e* and slots 1*f*. By the way, this embodiment is an example of modification of the first embodiment. This embodiment relates to a method which can effectively prevent the adjacencies of the inward end of the slot 1*f* from generating an excessive amount of heat, with the modification of the hole 1*e* and the slot 1*f* in properties.

1) Amount of Circumventive Current I" and Size of Area of Lengthwise End Portion of Conductive Layer 1*a*, Through which Circumventive Current I" Flows Roughly speaking, there is a correlation between the amount of the circumventive current I" and the size of the area through which the circumventive current I" flows. Part (a) of FIG. 15 is a schematic drawing in which the area through which the circumventive current I" can flow, is simply indicated by a semicircle, the size of which corresponds to the size of the area through which the circumventive current I" flows. If the distance between two adjacent slots 1*f* is 2r, the size of a semicircle U indicated by a dotted line is $\pi r^2/2$. Referring to part (b) of FIG. 15, if the conductive layer 1*a* is doubled in the number of slots 1*f*, the distance between two adjacent slots 1*f* is reduced by ½. Thus, the sum of the two semicircles U' contoured by dotted lines reduces by ½. Tests indicate that the amount by which the heat is generated in the conductive layer 1*a* by electromagnetic induction is reduced by the circumventive current I" is equivalent to the amount by which the area through which the circumventive current I" can flow is reduced in size, as shown in FIG. 15.

The inventors of the present invention confirmed, from the studies of the thermography of the conductive layer 1*a* obtained when the coil 3, the core 2, and the conductive layer 1*a* were disposed in the positional relation shown in FIG. 7, that as the conductive layer 1*a* was doubled in the number of slots 1*f*, the size of the current path roughly matched the size of a combination of the semicircles (models) shown in part (b) of FIG. 15, and also, that the speed with which the adjacencies of the inward ends of the slots 1*f* increase in temperature was roughly halved.

2) Case in which Conductive Layer 1*a* is Provided with Combination of Holes 1*e* and Slots 1*f*

A case in which a hole 1*e* is placed between the two slots 1*f* is described. It is assumed here that the distance between the lengthwise right end 1*d*R of the conductive layer 1*a* and the farthest edge 1*e*2 of the hole 1*e* is AUL the distance between the lengthwise right end 1*d*R and the closest edge 1*el* of the hole 1*e* is B, and the distance from the lengthwise right end 1*d*R to the farthest edge 1*fl* of the slot 1*f* is C. Then, if the slots 1*f* are relatively long, and therefore, C>A>B, the area U through which the circumventive current I" can flow, as shown in part (a) of FIG. 16, is smaller than the area U shown in part (a) of FIG. 15.

Even if the positional relationship between the slots 1*f* and the hole 1*e* is different from the one shown in part (a) of FIG. 16, for example, A>C>B, the area U through which the circumventive current I" can flow can be reduced in size, based on the similar mechanism, as shown in part (b) of FIG. 16, and therefore, it is possible to reduce the speed with which the adjacencies of the inward ends of the slots 1*f* increase in temperature, by reducing the amount of the circumventive current I".

3) Width of Hole 1*e* and with of Slot 1*f*

Next, the relationship between the width of the slot 1*f* and that of the hole 1*e* is described. It is assumed here that the width (dimension) of the hole 1*e* in terms of the circumferential direction of the conductive layer 1*a* is A' and the width (dimension the slot 1*f* in terms of the circumferential direction of the conductive layer 1*a* is C'. Then if the slot 1*f* is relatively long, and C>A>B, the greater the width C' as shown in part (a) of FIG. 17, the smaller the area U, compared to the area U in part (a) of FIG. 16.

In a case in which the positional relationship between the slot 1*f* and the hole 1*e* are different, as shown in part (b) of FIG. 17, from the shown in part (a) of FIG. 17, even if A>C>B, the area U in which the circumventive current I" can flow can be reduced in size by increasing the hole 1*e* in the width A', because of a mechanism similar to the above-mentioned one.

The foregoing can be summarized as follows:

If A>C>B, the area U in which the circumventive current I" can flow can be reduced in size while minimizing the amount by which the lengthwise right portion 1*a*R is reduced in mechanical strength, by structuring the lengthwise right end portion 1*a*R so that A'>C' (A>C>B and A'>C') is satisfied; and if C>A>B, the area U in which the circumventive current I" can flow can be reduced in size while minimizing the amount by which the lengthwise right portion 1*a*R is reduced in mechanical strength, by structuring the lengthwise right end portion 1*a*R so that C'>A' (C>A>B and C'>A') is satisfied.

Therefore, it is possible to provide an image forming apparatus 100 which is significantly smaller in the amount by which the adjacencies of the inward ends of the slots 1*f* becomes excessively heated due to the current concentration to the adjacencies, and also, in the amount of heat generation in the out-of-sheet-path portions of the fixation roller 1.

[Miscellanies]

In the first and second embodiments, the image heating device in accordance with the present invention was a fixing device for fixing the unfixed toner image formed on a sheet of recording medium, to the sheet. However, the present invention is also applicable to image heating devices other than those in the first and second embodiments. For example, the present invention is also applicable to a device for reheating a toner image which has been temporarily fixed to a sheet of recording medium, in order to increasing the image in glossiness.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-239272 filed on Dec. 8, 2015, which is hereby incorporated by reference herein in its entirety.

What is claimed is:

1. A fixing apparatus for fixing an image formed on a recording material to the recording material, said fixing apparatus comprising:

a cylindrical rotatable member including an electroconductive layer and provided with a hole portion at least at one of longitudinal end portions;

a driving member engaged with the longitudinal end portion of said rotatable member that has said hole portion, and configured to rotate said rotatable member, said driving member being provided with a claw portion engaged with said hole portion of said rotatable member;

a coil provided inside said rotatable member and configured to form an alternating magnetic field capable of causing electromagnetic induction heat generation of said electroconductive layer, said coil including a helical configuration portion having a helicity axis extending along a generatrix direction of said rotatable member; and a magnetic core provided inside said helical configuration portion, wherein said rotatable member generates heat by a current flowing in a circumferential direction of said rotatable member induced in said electroconductive layer in the alternating magnetic field, wherein said rotatable member is provided with a slot at the longitudinal end portion, said slot being disposed at a position different from a position of said hole portion with respect to the circumferential direction of said rotatable member and overlapping said hole portion with respect to a longitudinal direction of said rotatable member, and wherein a length A from an end surface of said rotatable member at the longitudinal end having said hole portion to an end surface of said hole portion remotest from the end surface of said rotatable member, a length B from the end surface of said rotatable member to an end surface of said hole portion closest to the end surface of said rotatable member, a width A' of said hole portion measured along a circumferential direction of said rotatable member, a length C of said slot measured along the longitudinal direction of said rotatable member, and a width C' of said slot measured along a circumferential direction of said rotatable member satisfy one of (i) $A>C>B$ and $A'>C'$, and (ii) $C>A>B$ and $C'>A'$.

2. The fixing apparatus according to claim 1, wherein a plurality of hole portions and a plurality of slots are provided along the circumferential direction of said rotatable member with intervals between adjacent slots, and wherein said hole portions and said slots are provided alternately in the circumferential direction of said rotatable heating member.

3. The fixing apparatus according to claim 1, wherein said slot is provided at each of the longitudinal end portions of said rotatable member.

4. The fixing apparatus according to claim 1, wherein said slot and said hole portion are disposed at positions not opposing the recording material.

* * * * *